US012480390B2

(12) United States Patent
Cunningham et al.

(10) Patent No.: US 12,480,390 B2
(45) **Date of Patent: *Nov. 25, 2025**

(54) SUBMERSIBLE WELL FLUID SYSTEM

(71) Applicant: FMC Technologies, Inc., Houston, TX (US)

(72) Inventors: Christopher E. Cunningham, Spring, TX (US); Eduardo Cardoso, Rio de Janeiro (BR); Timothy Bartlett, Spring, TX (US); Paulo Guedes-Pinto, Round Rock, TX (US); Co Si Huynh, La Brea, CA (US); Robert Perry, Katy, TX (US); John Davis Sink, Yorba Linda, CA (US)

(73) Assignee: FMC Technologies, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/664,770

(22) Filed: May 24, 2022

(65) Prior Publication Data

US 2022/0282602 A1 Sep. 8, 2022

Related U.S. Application Data

(63) Continuation of application No. 16/291,050, filed on Mar. 4, 2019, now Pat. No. 11,352,863, which is a (Continued)

(51) Int. Cl.
*E21B 43/12* (2006.01)
*E21B 43/01* (2006.01)

(Continued)

(52) U.S. Cl.
CPC ..... *E21B 43/121* (2013.01); *E21B 43/01* (2013.01); *F04B 17/03* (2013.01); *F04B 47/06* (2013.01);

(Continued)

(58) Field of Classification Search
None
See application file for complete search history.

(56) References Cited

U.S. PATENT DOCUMENTS 2,356,482 A 8/1944 Thrush
2,577,559 A 12/1951 Armstrong et al.

(Continued)

FOREIGN PATENT DOCUMENTS

CN 1694335 A 11/2005
CN 101675249 A 3/2010

(Continued)

OTHER PUBLICATIONS

Decision on Grant a Patent for Invention, RU Application No. 2412-528708RU, Aug. 7, 2017, 9 pages.

(Continued)

*Primary Examiner* — Benjamin M Kurtz
(74) *Attorney, Agent, or Firm* — Fish & Richardson P.C.

(57) ABSTRACT

A submersible well fluid system for operating submerged in a body of water may include an electric machine and a fluid end. The electric machine includes a rotor and a stator residing in a first housing at specified conditions. The fluid end may include an impeller and be coupled to the electric machine. The submersible well fluid system may also include an adjustable speed drive for the electric machine in the housing. The submersible well fluid system may also include a chemical distribution system for supplying treatment chemicals to the submersible well fluid system, a barrier fluid supply system for supplying a barrier fluid to the submersible well fluid system, and a pressure management system.

12 Claims, 17 Drawing Sheets

Related U.S. Application Data continuation of application No. 14/777,408, filed as application No. PCT/US2014/026745 on Mar. 13, 2014, now Pat. No. 10,221,662.

(60) Provisional application No. 61/801,793, filed on Mar. 15, 2013.

(51) Int. Cl.

| | |
|---|---|
| ***F04B 17/03*** | (2006.01) |
| ***F04B 47/06*** | (2006.01) |
| ***F04D 13/10*** | (2006.01) |
| ***F04D 17/10*** | (2006.01) |
| ***F04D 19/00*** | (2006.01) |
| ***F04D 25/06*** | (2006.01) |
| ***F04D 27/00*** | (2006.01) |
| ***F04D 29/10*** | (2006.01) |
| ***F04D 29/52*** | (2006.01) |
| ***F04D 31/00*** | (2006.01) |
| *F04D 29/32* | (2006.01) |

(52) U.S. Cl.

CPC ..... *F04D 13/10* (2013.01); *F04D 17/10* (2013.01); *F04D 19/002* (2013.01); *F04D 25/0686* (2013.01); *F04D 27/004* (2013.01); *F04D 29/104* (2013.01); *F04D 29/108* (2013.01); *F04D 29/522* (2013.01); *F04D 31/00* (2013.01); *F04D 29/32* (2013.01)

(56) References Cited

U.S. PATENT DOCUMENTS

| | | | | |
|---|---|---|---|---|
| 2,947,259 | A | 8/1960 | Wright et al. | |
| 2,968,248 | A | 1/1961 | Carter | |
| 2,970,548 | A | 2/1961 | Berner | |
| 2,996,994 | A | 8/1961 | Wright | |
| 3,074,347 | A | 1/1963 | Clymer | |
| 3,213,736 | A | 10/1965 | Keeton | |
| 3,411,450 | A | 11/1968 | Clifton | |
| 3,520,642 | A | 7/1970 | Garland | |
| 3,802,804 | A | 4/1974 | Zimmermann | |
| 3,816,513 | A | 6/1974 | Wakamatsu et al. | |
| 4,080,112 | A | 3/1978 | Zimmermann | |
| 4,235,569 | A | 11/1980 | Wegner et al. | |
| 4,266,914 | A | 5/1981 | Dickinson | |
| 4,276,002 | A | 6/1981 | Anderson | |
| 4,347,132 | A | 8/1982 | Davis | |
| 4,358,247 | A | 11/1982 | Suzuki | |
| 4,411,599 | A | 10/1983 | Kessel | |
| 4,526,518 | A | 7/1985 | Wiernicki | |
| 4,752,194 | A | 6/1988 | Wienen et al. | |
| 4,834,624 | A | 5/1989 | Jensen et al. | |
| 4,923,068 | A * | 5/1990 | Crowson | B01D 29/66 210/741 |
| 4,969,803 | A | 11/1990 | Turanskyj | |
| 4,998,863 | A | 3/1991 | Klaus | |
| 5,090,944 | A | 2/1992 | Kyo et al. | |
| 5,248,245 | A | 9/1993 | Behnke et al. | |
| 5,266,196 | A * | 11/1993 | Fife | B01D 35/26 257/E21.59 |
| 5,297,940 | A | 3/1994 | Buse | |
| 5,302,091 | A | 4/1994 | Horiuchi | |
| 5,310,265 | A | 5/1994 | Stangeland | |
| 5,334,004 | A | 8/1994 | Lefevre | |
| 5,398,762 | A | 3/1995 | Stinessen | |
| 5,485,905 | A | 1/1996 | Rader | |
| 5,642,989 | A | 7/1997 | Keddie | |
| 5,660,520 | A | 8/1997 | Scarsdale | |
| 5,779,456 | A | 7/1998 | Bowes | |
| 6,059,539 | A | 5/2000 | Nyilas et al. | |
| 6,213,736 | B1 | 4/2001 | Weisser | |
| 6,293,772 | B1 | 9/2001 | Brown et al. | |
| 6,322,335 | B1 | 11/2001 | Shi | |
| 6,424,066 | B1 | 7/2002 | Watson et al. | |
| 6,443,710 | B1 | 9/2002 | Tatsukami et al. | |
| 6,520,745 | B1 | 2/2003 | Yamamoto | |
| 6,655,930 | B2 | 12/2003 | Sato et al. | |
| 6,702,554 | B1 | 3/2004 | Sorensen | |
| 6,722,858 | B2 | 4/2004 | Yoshimura | |
| 6,863,124 | B2 | 3/2005 | Araux et al. | |
| 7,001,063 | B1 | 2/2006 | Markle | |
| 7,011,152 | B2 | 3/2006 | Soelvik | |
| 7,137,793 | B2 | 11/2006 | Shafer et al. | |
| 7,178,592 | B2 | 2/2007 | Chitty et al. | |
| 7,325,606 | B1 | 2/2008 | Vail | |
| 7,370,697 | B1 | 5/2008 | Sakamoto | |
| 7,429,809 | B2 | 9/2008 | Huster | |
| 7,530,391 | B2 | 5/2009 | Hall et al. | |
| 7,549,205 | B2 | 6/2009 | Shafer | |
| 7,741,744 | B2 | 6/2010 | Watson et al. | |
| 7,950,906 | B2 | 5/2011 | Hall, Jr. et al. | |
| 8,096,353 | B2 | 1/2012 | Ver Meer | |
| 8,210,835 | B2 | 7/2012 | Asaka | |
| 8,257,055 | B2 | 9/2012 | Beg et al. | |
| 9,954,414 | B2 | 4/2018 | Cunningham et al. | |
| 10,161,418 | B2 | 12/2018 | Cunningham et al. | |
| 10,221,662 | B2 | 3/2019 | Cunningham et al. | |
| 10,393,115 | B2 | 8/2019 | Cunningham et al. | |
| 10,801,309 | B2 | 10/2020 | Cunningham et al. | |
| 11,352,863 | B2 * | 6/2022 | Cunningham | F04D 27/004 |
| 2002/0054820 | A1 | 5/2002 | Fukamachi et al. | |
| 2003/0132003 | A1 | 7/2003 | Arauz et al. | |
| 2004/0144534 | A1 | 7/2004 | Lee | |
| 2004/0223864 | A1 | 11/2004 | Miller | |
| 2005/0019182 | A1 | 1/2005 | Klein et al. | |
| 2005/0089419 | A1 | 4/2005 | Arauz | |
| 2005/0093382 | A1 | 5/2005 | Hirth | |
| 2005/0142003 | A1 | 6/2005 | Hembree | |
| 2005/0184008 | A1 * | 8/2005 | Schacht | B01D 65/00 134/22.12 |
| 2005/0214141 | A1 | 9/2005 | Huster et al. | |
| 2006/0157251 | A1 | 7/2006 | Stinessen et al. | |
| 2006/0175064 | A1 | 8/2006 | Yuratich | |
| 2006/0210412 | A1 | 9/2006 | Lawyer et al. | |
| 2007/0048157 | A1 | 3/2007 | Collins | |
| 2008/0128128 | A1 | 6/2008 | Vail | |
| 2008/0169098 | A1 * | 7/2008 | Christopher | E21B 43/385 166/275 |
| 2008/0314616 | A1 | 12/2008 | Benestad et al. | |
| 2009/0022609 | A1 | 1/2009 | Pyatov et al. | |
| 2009/0098003 | A1 | 4/2009 | Kothnur et al. | |
| 2009/0263265 | A1 | 10/2009 | Mathijssen | |
| 2010/0074777 | A1 | 3/2010 | Laufer | |
| 2010/0143166 | A1 | 6/2010 | Head | |
| 2010/0150740 | A1 | 6/2010 | Veland | |
| 2010/0201129 | A1 | 8/2010 | Holstein | |
| 2010/0278672 | A1 | 11/2010 | Kothnur et al. | |
| 2010/0284829 | A1 | 11/2010 | Sloteman et al. | |
| 2011/0024195 | A1 | 2/2011 | Hoyer | |
| 2011/0044831 | A1 | 2/2011 | Cunningham | |
| 2011/0050017 | A1 | 3/2011 | Cunningham | |
| 2011/0052432 | A1 | 3/2011 | Cunningham | |
| 2011/0058965 | A1 | 3/2011 | Cunningham | |
| 2011/0097216 | A1 | 4/2011 | Kuzdzal | |
| 2011/0155385 | A1 | 6/2011 | Haheim | |
| 2012/0048113 | A1 | 3/2012 | Anderson et al. | |
| 2012/0055335 | A1 | 3/2012 | Mateman | |
| 2012/0100014 | A1 | 4/2012 | Seitter | |
| 2012/0103188 | A1 | 5/2012 | Stinessen et al. | |
| 2012/0132079 | A1 | 5/2012 | Naess | |
| 2012/0242046 | A1 | 9/2012 | Spielvogel | |
| 2012/0308408 | A1 | 12/2012 | Rosvold | |
| 2013/0043034 | A1 | 2/2013 | Drablier | |
| 2014/0023535 | A1 | 1/2014 | Hoshi et al. | |
| 2014/0158320 | A1 | 6/2014 | Archer et al. | |
| 2015/0316072 | A1 | 11/2015 | Cunningham et al. | |
| 2015/0322756 | A1 | 11/2015 | Cunningham et al. | |
| 2015/0326094 | A1 | 11/2015 | Cunningham | |
| 2015/0345265 | A1 | 12/2015 | Cunningham | |

(56) References Cited

U.S. PATENT DOCUMENTS

| | | | |
|---|---|---|---|
| 2016/0145980 | A1 | 5/2016 | Cunningham et al. |
| 2016/0341209 | A1 | 11/2016 | Landi et al. |

FOREIGN PATENT DOCUMENTS

| | | | |
|---|---|---|---|
| CN | 201650775 | U | 11/2010 |
| DE | 858196 | C | 12/1952 |
| FR | 2480360 | A1 | 10/1981 |
| FR | 2609118 | A1 | 7/1988 |
| FR | 2646882 | A1 | 11/1990 |
| GB | 2089446 | | 6/1982 |
| RU | 2303161 | C1 | 7/2007 |
| RU | 2409770 | C2 | 1/2011 |
| SU | 787583 | A1 | 12/1980 |
| WO | WO20010133083 | A1 | 5/2001 |
| WO | WO2009073414 | A2 | 6/2009 |
| WO | WO2009137316 | A1 | 11/2009 |
| WO | WO2009137323 | A1 | 11/2009 |
| WO | WO2010129749 | A1 | 11/2010 |
| WO | WO2011161516 | A1 | 12/2011 |
| WO | WO2012034984 | A2 | 3/2012 |
| WO | WO20120121605 | | 9/2012 |
| WO | WO20120141599 | | 10/2012 |
| WO | WO20130028594 | | 2/2013 |
| WO | WO2014042624 | | 3/2014 |

OTHER PUBLICATIONS

Extended European Search Report issued in European Application No. 14767998.9 on Dec. 9, 2016; 6 pages.

Intellectual Property Office of Singapore, Invitation to Respond to Written Opinion, Singapore Application No. 11201507523Q, Jul. 19, 2016, 9 pages.

International Preliminary Report on Patentability and Written Opinion of the International Searching Authority issued in International Application No. PCT/US2014/026745; issued on Sep. 15, 2015.

International Search Report and Written Opinion of the International Searching Authority issued in International Application No. PCT/US2014/026745 on Jul. 7, 2014; 24 pages.

Invitation to Respond to Written Opinion, Singapore Application No. 11201507523Q, Apr. 25, 2017; 8 pages.

Invitation to Respond to Written Opinion, Singapore Application No. 11201507523Q, Jan. 24, 2018; 5 pages.

Notice of Acceptance issued in Australian Application No. 2014236733 on Jun. 21, 2016; 5 pages.

Notice of Acceptance issued in Australian Application No. 20162350008 on Feb. 21, 2018; 5 pages.

Office Action issued in Australian Application No. 2016235008 in Dec. 7, 2017; 2 pages.

Office Action in European Appln. No. 19179447.8, mailed on Oct. 17, 2023, 6 pages.

European Patent Office Extended Search Report issued in European Application No. 19179447.8 on Oct. 1, 2019, 6 pages.

* cited by examiner

SUBMERSIBLE WELL FLUID SYSTEM

CLAIM FOR PRIORITY

This application is a continuation of U.S. patent application Ser. No. 16/291,050, filed Mar. 4, 2019, which is a continuation of U.S. patent application Ser. No. 14/777,408, filed Sep. 15, 2015, now allowed, which is a U.S. National Stage of PCT/US2014/026745 filed on Mar. 13, 2014, which claims priority from U.S. Provisional Application No. 61/801,793 filed on Mar. 15, 2013, the entire contents of the prior applications are hereby incorporated by reference.

FIELD

This disclosure pertains to submersible fluid systems, and more particularly, to submersible well fluid systems that operate submerged in a body of water.

BACKGROUND

The installation of a pump or pumps into the flow-stream associated with a hydrocarbon producing well can increase the absolute volume of reserves that can be produced from that well and can increase the rate at which such reserves can be produced. Pumps can reduce the back-pressure against which a well must flow by "pushing" the media upon which they act. Back-pressure is essentially the resistance to flow, and typically manifests as vertical height (fighting gravity), friction in a flowline or riser, a physical obstruction, etc.

DETAILED DESCRIPTION

Figure 1A:
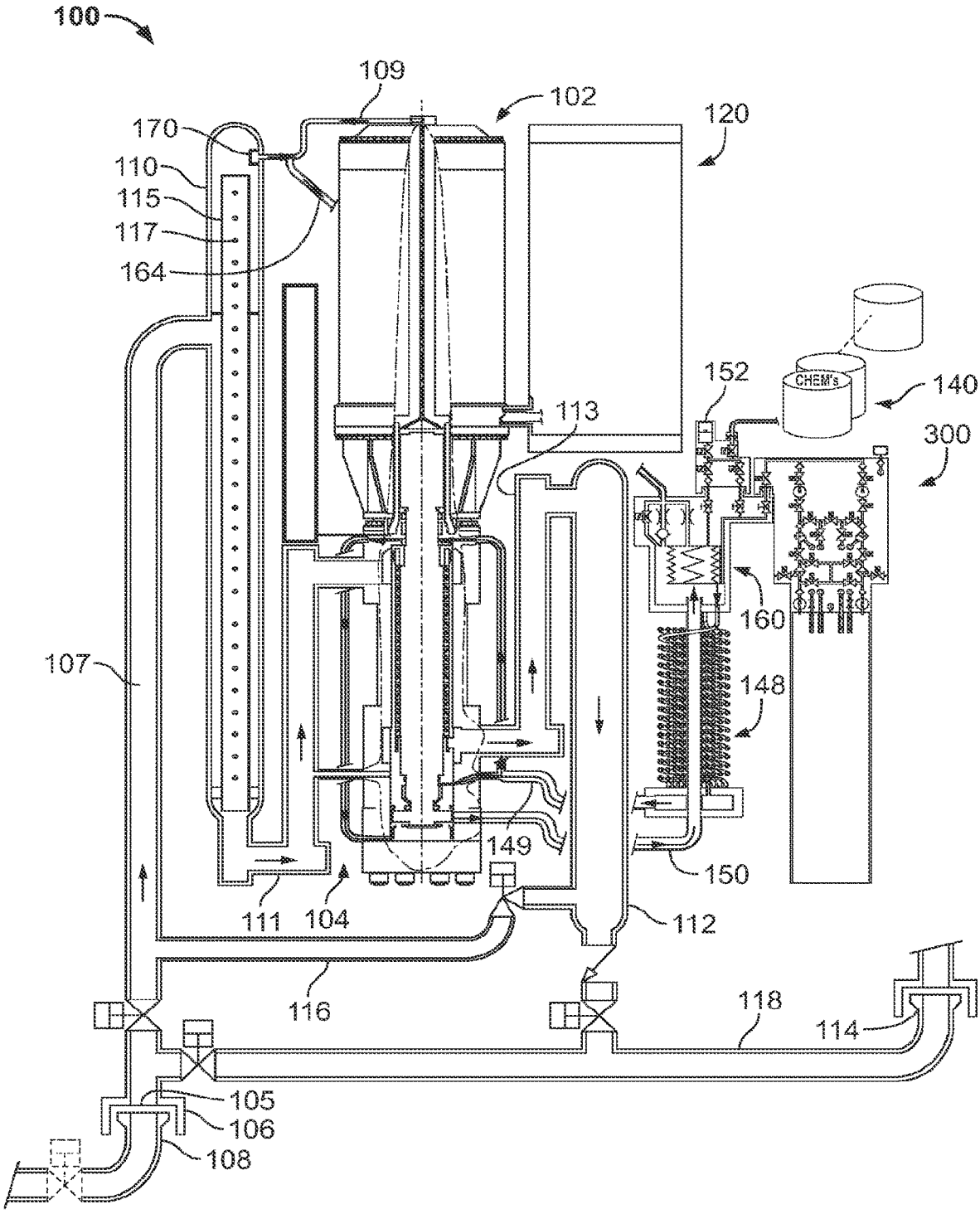
FIG. 1A is a schematic diagram of an example submersible well fluid system constructed in accordance with the concepts described herein.
Figure 1B:
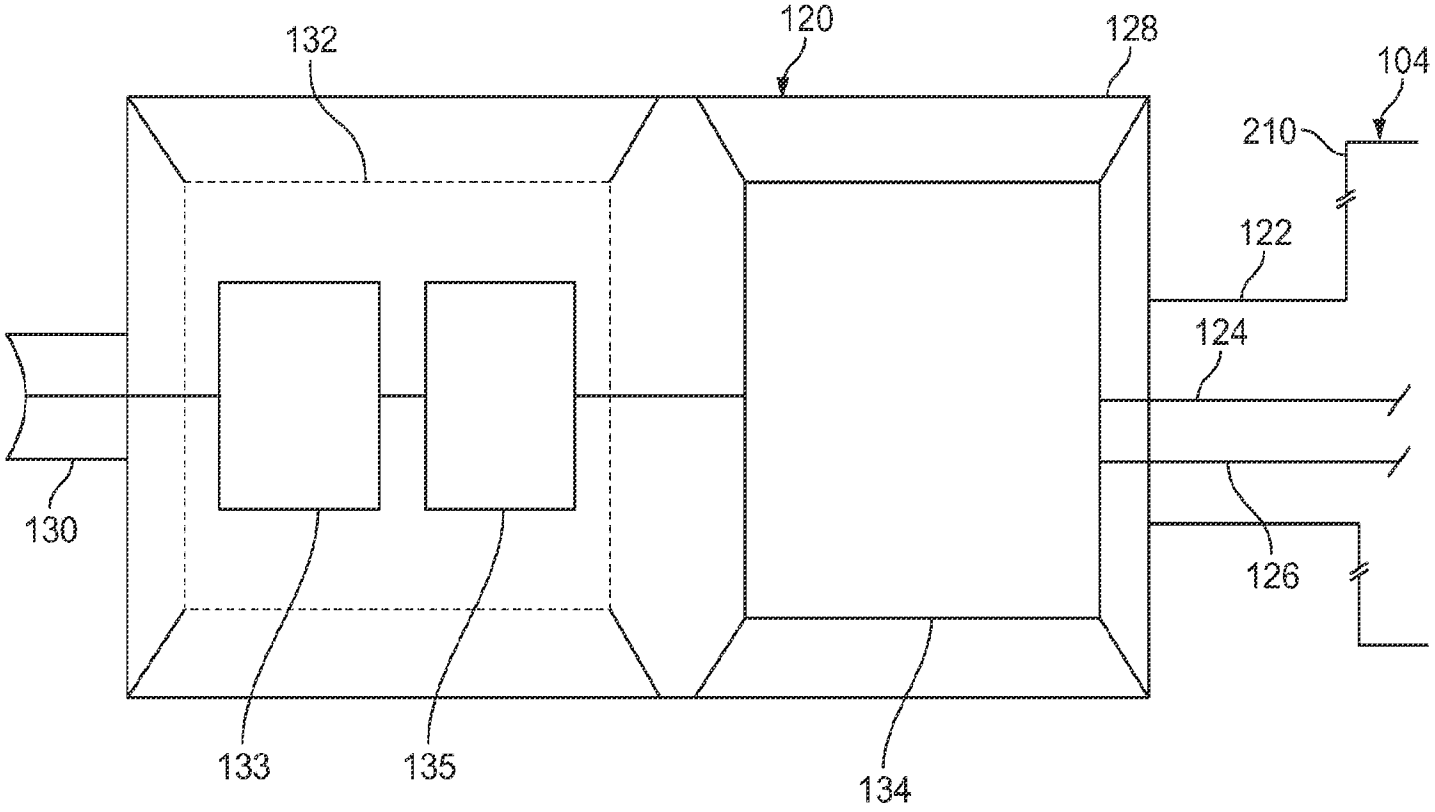
FIG. 1B is a schematic block diagram of an example adjustable speed drive.

The back-pressure reducing benefits are greatest when the pump is placed close to the producing reservoir. FIG. 1A is a schematic of an example submersible well fluid system 100 constructed in accordance with the concepts described herein. The submersible well fluid system 100 is designed to operate submerged in a body of water, including salt water, fresh water, pure water, non-aqueous environments, etc. The fluid system 100 includes a fluid end 104 coupled to an electric machine 102. The electric machine 102 is in fluid communication with an adjustable speed drive 120 through a conduit 122. The submersible well fluid system 100 also includes a process chemical distribution system 140, a barrier fluid supply system 300, and a pressure management system 160.

Electric machine 102 includes a rotor and a stator residing in an electric machine housing 210 (also referred to as a first housing). As described in more detail below, electric machine 102 is an alternating current (AC), synchronous, permanent magnet (PM) electric machine having a rotor that includes permanent magnets and a stator that includes a plurality of formed or cable windings and a (typically) stacked-laminations core. In other instances electric machine 102 can be another type of electric machine such as an AC, asynchronous, induction machine where both the rotor and the stator include windings and laminations, or even another type of electric machine. Electric machine 102 can operate as a motor producing mechanical movement from electricity, a generator producing electric power from mechanical movement, or alternate between generating electric power and motoring. In motoring, the mechanical movement output from electric machine 102 can drive fluid end 104. For generating power, fluid end 104 supplies mechanical movement to electric machine 102, and electric machine 102 converts the mechanical movement into electric power.

The fluid end 104 includes an impeller coupled to the electric machine. The impeller is coupled to a shaft that is driven by the rotor of the electric machine. In some implementations, the impeller and shaft are components of a pump (the shaft is a pump shaft). In other implementations the impeller and shaft may be components of a turbine or compressor. In instances where fluid end 104 is driven by electric machine 102, fluid end 104 can include any of a variety of different devices. For example, fluid end 104 can include one or more rotating and/or reciprocating pumps, rotating and/or reciprocating compressors, mixing devices, or other devices. Some examples of pumps include centrifugal, axial, rotary vane, gear, screw, lobe, progressing cavity, reciprocating, plunger, diaphragm and/or other types of pumps. Some examples of compressors include centrifugal, axial, rotary vane, screw, reciprocating and/or other types of compressors, including that class of compressors sometimes referred to as "wet gas compressors" that can accommodate a higher liquid content in the gas stream than is typical for conventional compressors. In other instances fluid end 104 may include one or more of a fluid motor operable to convert fluid flow into mechanical energy, a gas turbine system operable to combust an air/fuel mixture and convert the energy from combustion into mechanical energy, an internal combustion engine, and/or other type of prime mover. In any instance, fluid end 104 can be single or multi-stage.

As mentioned previously, the submersible well fluid system 100 may be operated at a specified depth in a body of water e.g. associated with a hydrocarbon production or injection well in a lake, river, ocean, sea, or other body of water. Fluid end 104 and electric machine 102 are packaged within a shared pressure vessel or separate pressure vessels sealed to prevent passage of fluid between the interior of the pressure vessel(s) and the surrounding environment (e.g. surrounding seawater). Submersible well fluid system 100 components are constructed to withstand ambient pressure about fluid system 100 and thermal loads exerted by the surrounding environment, as well as pressures and thermal loads incurred in operating electric machine 102 and fluid end 104.

The electric machine housing 210 contain contains a fluid at specified conditions. In some circumstances, the fluid at the specified conditions is at ambient pressure when the submersible well fluid system 100 is submerged to the specified depth in the body of water. The fluid at the specified conditions may include gas (the term gas includes a fluid that is entirely gas or may be substantially gas—the fluid may contain condensation or the liquid produced from the degradation of internal components or from out-gassing). The gas may be substantially at atmospheric pressure. For example, the gas may be introduced to the electric machine housing 210 at atmospheric pressure, but may undergo pressure changes as the submersible well fluid system 100 and/or components thereof experience changes in temperatures and pressures, such as being submerged into a specified depth of water. At other specified conditions, the fluid in the electric machine housing 210 may be substantially liquid.

The submersible well fluid system 100 includes a process fluid inlet 105 coupled to (or in fluid communication with) a fluid path 107 to the fluid end 104. The process fluid inlet 105 includes a process fluid inlet connector 106 that can be connected to a fluid outlet 108 associated with a wellhead assembly (i.e., connected to the wellhead assembly, such as a Christmas Tree assembly, or an assembly downstream of the wellhead assembly, such as a manifold, pump-base, boosting station, sled for flow lines, riser base, etc.).

A buffer tank 110 may reside in the fluid path 107 of the process fluid inlet 105 (e.g., downstream of the process fluid inlet 105). The buffer tank 110 is configured to mix (or homogenize) uncombined gas and liquid process fluid from the process fluid inlet 105 and to supply the mixed gas and liquid process fluid to the fluid end 104. For example, the buffer tank 110 may include an outer wall and a perforated inner wall 115. Process fluid is directed from the process fluid inlet 105 along the fluid path 107. The process fluid in fluid path 107 tends to be separated liquid- and gas-phase process fluid. The liquid portion can enter the buffer tank 110, impinging on the perforated inner wall 115, and flow downwards towards the fluid path 111. Gas-phase process fluid can rise to the top of the buffer tank 110 and flow downwards through the open center of the perforated inner wall 115. The liquid-phase process fluid mixes with the gas by passing through the perforations 117 in the perforated inner wall 115. The resulting process fluid is a more homogenized liquid/gas fluid mixture (than entered the buffer tank 110) that flows through fluid path 111 and into the fluid end 104.

Multiphase fluid enters subsea fluid system 100 at inlet 105 for transport through a fluid path 107 to buffer tank 110. Raw hydrocarbon production fluids delivered to subsea fluid system 100 from wells, directly or by way of other downstream assemblies (e.g. manifolds, etc.) may at various times include as much as 100% gas or 100% liquids, as well as all fractional combinations of gas and liquids (often with some volume of solids in addition). Transition between gas-dominated and liquid-dominated multiphase streams may occur frequently (e.g. time frame of seconds or less) or rarely, and such transitions may be gradual or abrupt. Abrupt changes from very high Gas Volume Fraction (GVF) streams to very low GVF streams, and vice-versa (typically referred to as "slugging"), can be harmful to submersed fluid system 100 for reasons known to those skilled in the art of fluid-boosting devices and associated pipe systems. Buffer tank 110 can accommodate even rapidly changing fluid conditions at inlet and reduce the abruptness of such fluid condition changes at its main outlet, and in so doing, moderate the detrimental effects on downstream fluid system 100. Buffer tank 110 amounts to a "fat spot" in the fluid path 107 that allows fluid to reside there long enough for gravity to drive heavier streams/elements (liquid, solids) to the bottom of the tank while concurrently forcing gas to rise to the top of the tank. A perforated stand-pipe or similar device (illustrated as perforated inner wall 115) controls the rate at which the separated streams/elements are rejoined before exiting the tank at main outlet. Notably, when a high-GVF multiphase flow stream enters buffer tank 110, the volume of gas in the tank may increase relative to the volume of liquid/solids already in the tank, and similarly when a low-GVF stream enters the tank the opposite may occur. Meanwhile, the GVF of the fluid exiting the tank will typically be different from that entering because the exit-stream GVF is automatically (and gradually) adjusted in accordance with the volume of gas and liquid/solids permitted to enter perforated stand-pipe 312. The gas/liquid interface level in buffer tank 306 dictates the flow area (number of holes 117) accessible to each stream.

The buffer tank 110 may also be fluidically coupled to gas flow lines 109 and 164. Gas flow line 109 provides gas to the inner portion of the electric machine 102 (described in more detail in FIGS. 2A—C). Gas flow line 164 can provide gas to the pressure management system 160, which is described in more detail in the text accompanying FIGS. 1C—F.

The submersible well fluid system 100 also includes a process fluid outlet 114 coupled to a fluid path 113 from the fluid end 104. A gas/liquid separator 112 may reside in the fluid path 113 downstream from the fluid end 104 (in some cases, downstream of the impeller) and adapted to output to the process fluid outlet 114. A recirculation fluid path 116 may be coupled to the gas/liquid separator 112 and to the fluid path 107 from the process fluid inlet 105. In some implementations, the gas/liquid separator 112 is adapted to preferentially output liquid to the recirculation fluid path 116, but may in some cases output one or both of liquid and gas to the recirculation fluid path 116. The submersible well fluid system 100 may also include a bypass fluid path 118 coupled to the process fluid inlet 105 and the process fluid outlet 114 to bypass the fluid end 104. The process fluid bypasses the fluid end 104 by activation of one or more valves. The bypass fluid path 118 may be a tubing. The fluid end 104 and the electric machine 102 are described in more detail in FIGS. 2A—B below.

Figure 1C:
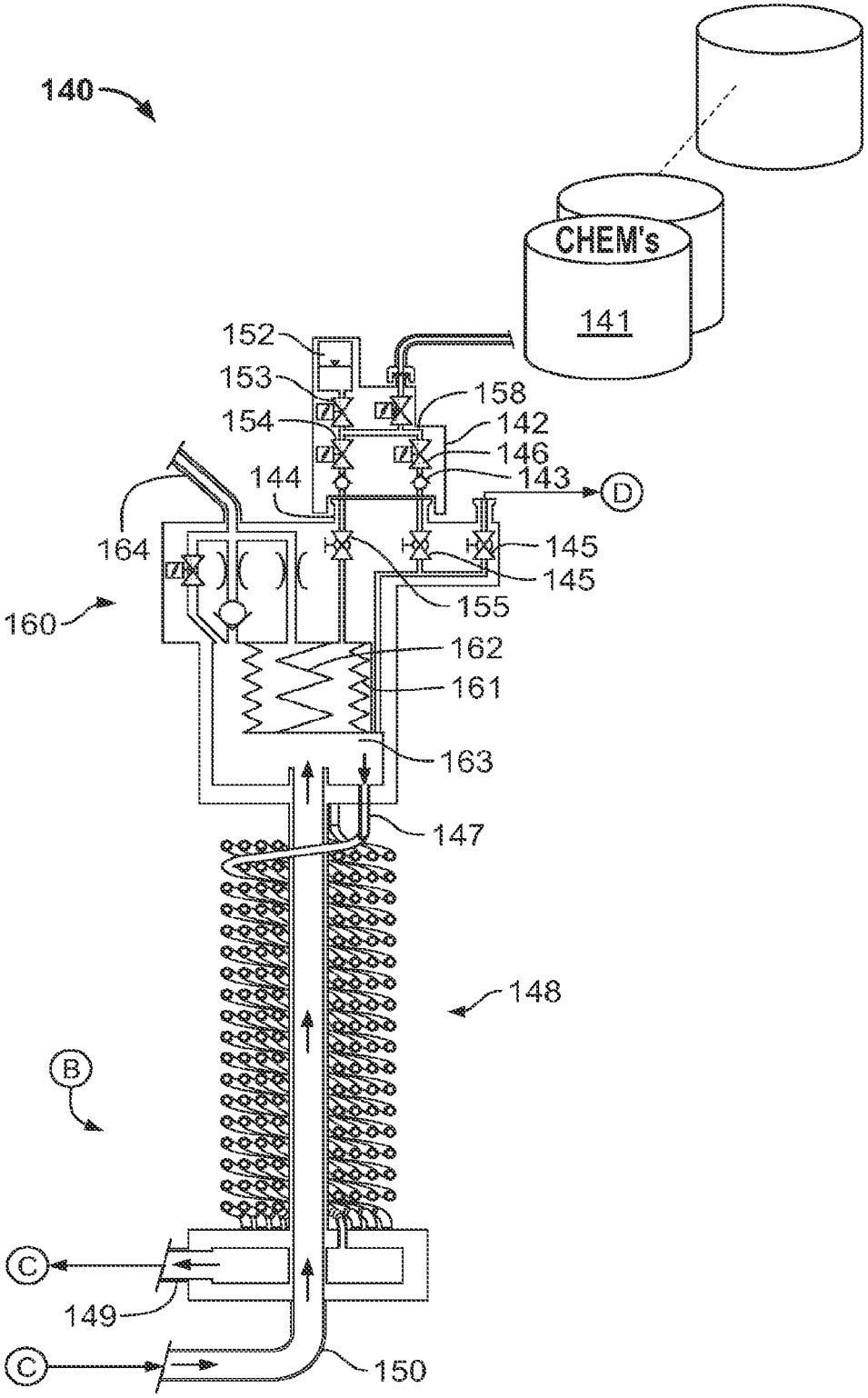
FIG. 1C is a schematic diagram showing a schematic diagram of a process chemical distribution system and a pressure management system of the submersible well fluid system of FIG. 1A.
Figure 1D:
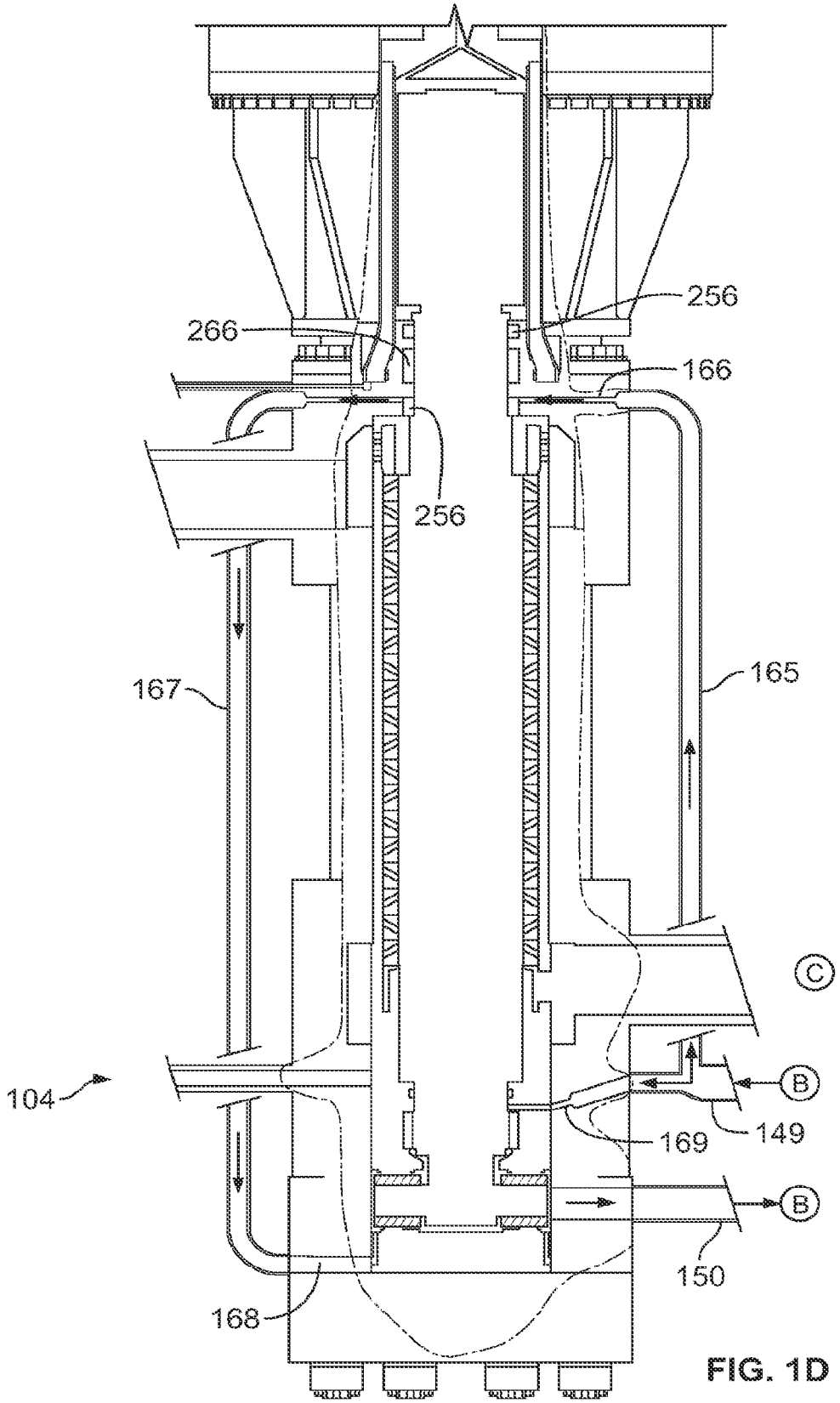
FIG. 1D is a schematic diagram showing a close-up view of the fluid end of the submersible well fluid system of FIG. 1A.
Figure 2A:
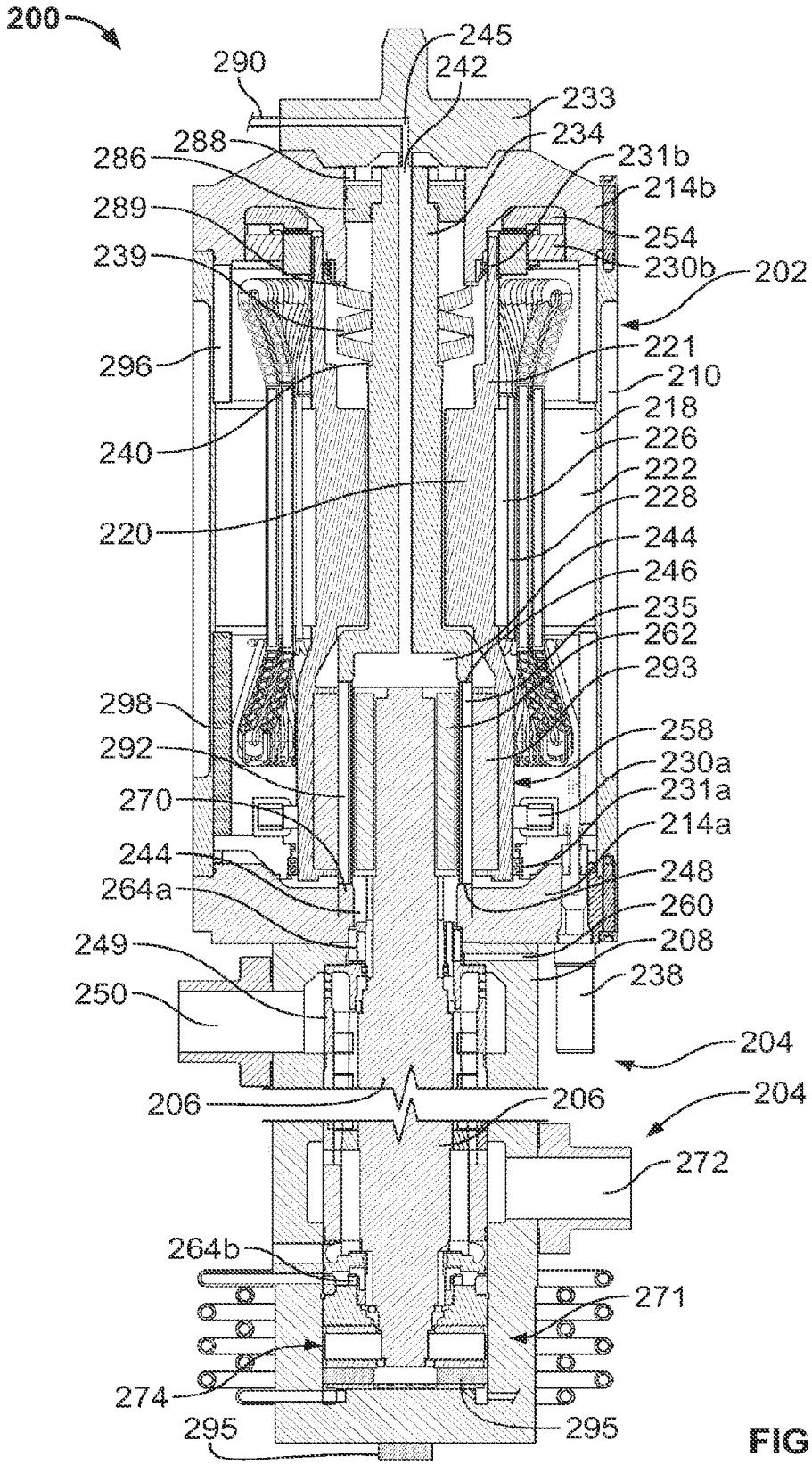
FIG. 2A is a side cross-sectional view of an example integrated electric machine and fluid end that can be used in the example fluid system of FIG. 1.

FIG. 2A is a side cross-sectional view of an example fluid system 200 that includes an example integrated electric machine 202 and fluid end 204. The fluid system 200 can be used in the submersible well fluid system 100 of FIG. 1. Fluid end 204 is similar to fluid end 104 of FIG. 1. Fluid end 104 includes a fluid rotor 206 disposed in a fluid end housing 208. Fluid end housing 208 contains process fluids flowing from an inlet 250 near electric machine 202 to an outlet 272 distal the electric machine 202. Electric machine 202 is carried by, and contained within, an electric machine housing 210 attached to fluid end housing 208 of fluid end 204 by way of end-bell 214*a*. Electric machine housing 210 is attached at its upper end to end-bell 214*b*, which is attached to cap 233. The aforementioned attachments are sealed to create a pressure vessel encapsulating electric machine 202 that prevents passage of fluid between its interior and the surrounding environment (e.g. water). Another collection of parts and interfaces (described later in this disclosure) prevents passage of fluid between electric machine 202 and fluid end 204. As a result of the mentioned barriers, electric machine 202 operates in its own fluid environment, which may be gas or liquid depending on specific trade-offs (with gas preferred from a system overall efficiency perspective). FIG. 2A depicts a close-coupled subsea fluid system 200 in that electric machine 202 structural elements attach directly to fluid end 204 structural elements.

Electric machine 202 disposed within electric machine housing 210 includes an electric machine stator 218 and an electric machine rotor 220. Electric machine stator 218 is interfaced with an external power supply by penetrators/connectors 238 which pass-through lower end-bell 214*a*. It is known to those skilled in the art of underwater electric power interconnect systems that minimizing pressure differential acting across such interfaces is recommended for long-term success.

Electric machine rotor 220 is magnetically-coupled to rotate with process fluid rotor 206. Electric machine rotor 220, which can be tubular, includes a rotor shaft (or core in the case of an AC machine) 221 and permanent magnets 226 affixed to the exterior of rotor shaft 221, particularly, in an area proximate stator core 222. Permanent magnets 226 are secured to rotor shaft 221 by a sleeve 228 including any material and/or material construct that does not adversely affect the magnetic field and that satisfies all other design and functional requirements. In certain instances sleeve 228 can be made from an appropriate non-ferrous metal, e.g. "AISI 316" stainless steel or Inconel, or it can include a fiber-resin composite such as carbon-fiber, ceramic fiber, basalt fiber, aramid fiber, fiber glass, and/or another fiber in e.g. a thermoplastic or thermoset resin matrix. Permanent magnets 226 provide a magnetic field that interacts with a magnetic field of stator 218 to at least one of rotate electric machine rotor 220 relative to stator 218 in response to electric power supplied to stator 218, or to generate electricity in stator 218 when rotor 220 is moved relative to stator 218.

Electric machine rotor 220 is supported to rotate in stator 218 by magnetic bearings 230*a* and 230*b* separated a significant distance relative to the length of electric machine rotor 220, and typically, but not essentially, proximate the ends of electric machine rotor 220. In at least one alternative to the configuration shown in FIG. 2A, magnetic bearing 230*a* might be positioned closer to stator core 222 such that a substantial portion or even all of magnetic coupling 258 extends beyond magnetic bearing 230*a* in what is known to those skilled in the art of rotating machinery as an over-hung configuration. Magnetic bearing 230*a* is a combination ("combo") magnetic bearing that supports electric machine rotor 220 both axially and radially, and magnetic bearing 230*b* is a radial magnetic bearing. In the case of a vertically-oriented electric machine 202, a passive magnetic lifting device 254 may be provided to carry a significant portion of the weight of electric machine rotor 220 to reduce the capacity required for the axial portion of magnetic combo bearing 230*a*, enabling smaller size and improved dynamic performance for combo bearing 230*a*. Machines incorporating magnetic bearings typically also include back-up bearings 231*a* and 231*b* to constrain motor rotor 220 while it spins to a stop in the event the magnetic bearings cease to be effective, e.g. due to loss of power or other failure. Back-up bearings 231*a*, 231*b* will support motor rotor 220 whenever magnetic bearings 230*a*, 230*b* are not energized, e.g. during transportation of fluid system 100. The number, type and/or placement of bearings in electric machine 202 and fluid end 204 may be different for different fluid system 100 configurations.

Other elements of electric machine 202 are intimately associated with integrated fluid end 204, and an overview of a few higher-level attributes for subsea fluid system 200 at this juncture may facilitate reader understanding of the functions and integrated operating nature of those other electric machine 202 elements.

Certain embodiments of subsea fluid system 200 may include: An electric machine 202 that operates in a gas environment at nominally 1-atmosphere pressure delivering lower losses than existing technologies (e.g. while its electric machine housing 210 is exposed externally to potentially deep seawater and associated high pressure); an electric machine 202 that utilizes magnetic bearings 230*a*, 230*b* for additional loss savings compared to machines operating in a submerged liquid environment using e.g. rolling element or fluid-film bearings; a magnetic coupling 258 for which an inner portion 262 is contained in potentially very high pressure process fluid and is isolated from its associated outer portion 293 located inside the nominally 1-atmosphere pressure environment of electric machine 202 by a static (non-rotating) sleeve 235 that along with its associated static (non-rotating) end-seals 246, 248 is able to withstand the large differential pressure acting there-across; an electric machine 202 that because of its 1-atmosphere operating environment, use of magnetic bearings 230*a*, 230*b*, and use of a magnetic coupling(s) 258 to engage its integrated fluid end(s) 204, produces much less heat during operation compared to other known technologies (used in subsea fluid system 200 applications) and that therefore can transfer its heat to the surrounding environment using passive, durable and low-cost ways; a way to cool magnetic coupling 258 that in certain circumstances may allow the inner portion 262 of that coupling to spin inside a gas-core (with accordant lower loss and other benefits); one or more fluid ends 204 that employ fluid-film bearings 264*a*, 264*b*, 274 or any other types of bearings lubricated and cooled by process fluid (e.g. water or oil or a combination thereof) or alternative fluid; an upper-inlet/lower outlet vertical fluid end 204 arrangement that provides a sump 271 at its lower-end to secure fluid-film bearings 264*b*, 274 in a serviceable environment.

Electric machine housing 210 (and associated parts) plus magnetic coupling 258 combined with sleeve 235 (and associated parts) establish three substantially separate environments that can be exploited for unprecedented value for subsea fluid systems 200, i.e.: A potentially process gas environment inside sleeve 235 at the upper end of fluid end 204 (otherwise process multiphase fluid or liquid); a nominally 1-atmosphere gas environment outside sleeve 235 and inside electric machine housing 210; an underwater environment outside of electric machine housing 210 (and also outside fluid end housing 208). In an alternative embodiment, the environment inside electric machine housing 210 may be pressurized (e.g. with gas or liquid) a little or a lot (i.e. any of various levels up to and including that of the process fluid), with accordant tradeoffs in overall system efficiency (increased losses), possibly different cross-section for e.g. electric machine housing 210, upper sleeve 296 and lower sleeve 298, reduced cross-section of sleeve 235 and therefore increased efficiency of magnetic coupling 258, different pressure field across e.g. electric power penetrators, different heat management considerations, etc. With the preceding context, additional description will now be provided for electric machine 202 components and other subsea fluid system 200 components.

Consistent with the present disclosure, it is to be understood that process fluid may be used to lubricate and cool fluid-film or other types of bearings 264*a*, 264*b*, 274 in fluid end 204, and to cool magnetic coupling 258. It is further understood that process fluid in liquid form will better satisfy the requirements of process-lubricated-and-cooled bearings (not applicable if fluid end 204 uses magnetic bearings), and that process fluid containing some gas may benefit the coupling-cooling application, i.e. by reducing drag-loss associated with process fluid rotor 206 motion and conducting heat from inside sleeve 235. Process fluid for the noted applications may be sourced from any of, or more than one of, several locations relative to subsea fluid system 200 depending on the properties of the process fluid at such source location(s) (e.g. water, oil, multiphase), the pressure of such source(s) relative to the point of use, and the properties required for fluid at the point of use. For example, process fluid may come from upstream of subsea fluid system 200, such as from buffer tank 278, liquid reservoir 284 or other sources including some not associated with the process stream passing through subsea fluid system 200 and/or some associated with the process stream passing through subsea fluid system 200 that are subject to e.g. pre-conditioning before joining the process stream passing though subsea fluid system 200 (e.g. a well stream that is choked-down to a lower pressure before being co-mingled with one or more lower pressure flow streams including the flow stream ultimately entering subsea fluid system 200). Process fluid may be sourced from within subsea fluid system 200 itself (e.g. from any of subsea fluid system 200 pressure-increasing stages, proximate outlet 272, from sump 271 and/or immediately adjacent the respective desired point of use). Process fluid may be sourced downstream of subsea fluid system 200, e.g. from the downstream process flow stream directly or from liquid extraction unit 287, among others. Non-process stream fluids may also be used for lubrication and cooling, such as sea water sourced from the surrounding environment (possibly treated with suitable chemicals) and chemicals available at the e.g. seabed location and normally injected into the process stream to inhibit corrosion and/or the formation of e.g. hydrates and/or deposition of asphaltenes, scales, etc.

In instances where the upstream process fluid is used for lubrication and/or cooling, and the source does not exist at a pressure greater than that at the intended point of use, such process fluid may need to be "boosted." That is, the pressure of such process fluid may be increased using e.g. a dedicated/separate ancillary pump, an impeller integrated with a rotating element inside subsea fluid system 200, or by some other ways. In certain implementations the pressure drop across the fluid end inlet homogenizer (i.e. mixer) 249 can create a pressure bias sufficient to deliver desired fluids from upstream thereof to e.g. upper radial bearing 264*a* and coupling chamber 244, the latter being the space surrounding magnetic coupling inner portion 262 and residing inside sleeve 235 (this implementation is discussed further herein).

Regardless the process fluid source, it may be refined and/or cleaned prior to being delivered to the point(s) of use. For example, multiphase fluid may be separated into gas, one or more liquid streams, and solids (e.g. sand, metal particles, etc.), with solids typically diverted to flow into fluid end 204 via its main inlet 250 and/or collected for disposal. Such fluid separation may be achieved using e.g. gravitational, cyclonic centrifugal and/or magnetic mechanisms (among other mechanisms) to achieve fluid properties desired for each point of use. After the fluid has been cleaned, it may also be cooled by passing the refined fluid through e.g. thin-walled pipes and/or thin plates separating small channels, etc. (i.e. heat exchangers) exposed to the seawater.

Electric machine 202 includes a cap 233 secured to upper end-bell 214*b*. For the configuration shown in FIG. 2A, stub 234 is pressed downward onto sleeve 235 by spring mechanism 239 reacting between shoulder bearing ring 240 and shoulder bearing ring 289. End-bell 214*b*, electric machine housing 210, end-bell 214*a*, fluid end housing 208, sleeve support ring 270, and various fasteners associated with the preceding items close the axial load path for stub 234 and sleeve 235. Stub 234 contains an internal axial conduit 242 connecting the process environment inside sleeve 235 with a cavity provided between the upper end of stub 234 and the underside of cap 233. Cap 233 includes a conduit 245 connecting that underside cavity with external service conduit 290 which delivers e.g. process-sourced cooling fluid for the coupling (described previously). Pressurized fluid transported through the noted conduits fills the cavity below cap 233 and acts on stub 234 via bellow 288, piston 286 and liquid provided between bellow 288 and piston 286. The sealing diameter of piston 286 is dictated by the sealing diameter of sleeve 235 and the force created by spring mechanism 239, and is specified to ensure a substantially constant compressive axial load on sleeve 235 even in view of, e.g., pressure and temperature acting internal and external to subsea fluid system 200. For other variants of subsea fluid system 200 the aforementioned elements are modified to ensure a substantially constant tensile axial load is maintained on sleeve 235.

In certain instances sleeve 235 can be a gas-impermeable ceramic and/or glass cylinder maintained "in-compression" for all load conditions by an integrated support system, e.g. external compression sleeve 292 for radial support and stub 234-plus-sleeve support ring 270 for axial support. Sleeve 235 and external compression sleeve 292 are ideally made of materials and/or are constructed in such a way as to not significantly obstruct the magnetic field of magnetic coupling 258, and to generate little if any heat from e.g. eddy currents associated with the coupling rotating magnetic field. In certain instances, external compression sleeve 292 can be made of a fiber-resin composite, such as carbon-fiber, ceramic fiber, basalt fiber, aramid fiber, fiber glass and/or another fiber in e.g. a thermoplastic or thermoset resin matrix. In certain instances, external compression sleeve 292 can have metalized end surfaces and/or other treatments to facilitate a metal-to-metal seal with the corresponding surfaces of stub 234 and sleeve support ring 270.

In certain embodiments of subsea fluid system 200 electric machine 202 is filled with gas, e.g. air or an inert gas such as nitrogen or argon, at or near nominally 1-atmosphere pressure. Other than vacuum, which is difficult to establish and maintain, and which provides poor heat transfer properties, a very low gas pressure environment provides the best conditions for operating an electric machine efficiently (e.g. low drag loss, etc.), assuming heat produced by the machine can be removed efficiently.

When submerged in deep water the pressure outside gas-filled electric machine 202 will collapse e.g. electric machine housing 210 if it is not adequately strong or internally supported. In certain embodiments of subsea fluid system 200 electric machine housing 210 is thin and "finned" to improve transfer of heat between electric machine 202 and the surrounding environment. Machine housing 210 may be tightly fit around stator core 222 and sleeves 296, 298, and its ends similarly may be tightly-fit over support surfaces provided on end-bells 214*a*, 214*b*. The structures supporting machine housing 210 are sized to be sufficiently strong for that purpose, and where practical (e.g. for sleeves 296, 298) those structures can be made using materials with a useful balance of strength-to-mass and heat-transfer properties (e.g. select stainless steels and high-copper-content materials including 316 stainless steel and beryllium-copper, among others).

Figure 2B:
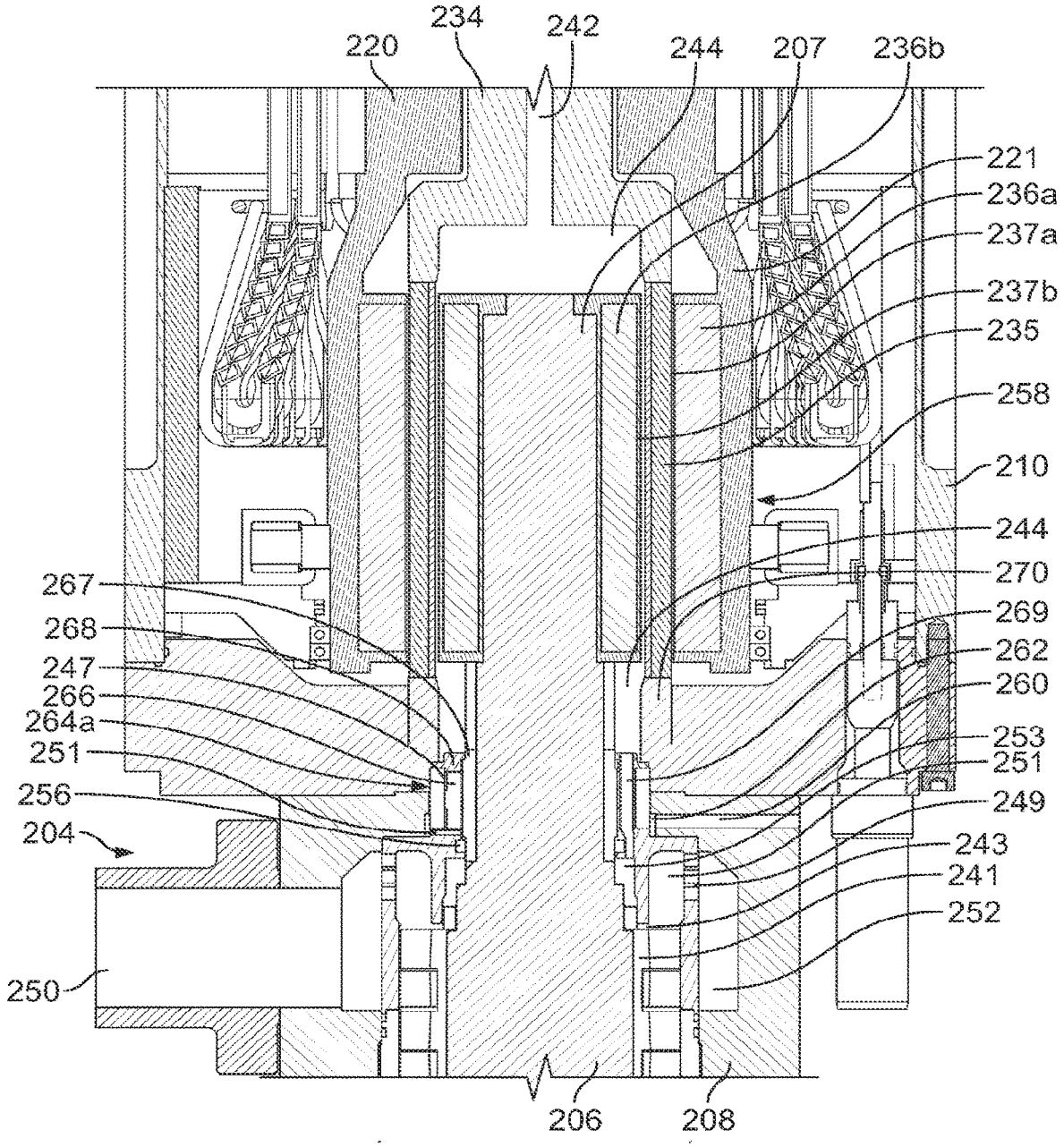
FIG. 2B is a side cross-sectional view of a fluid inlet portion and the magnetic coupling between an electric machine rotor and a fluid end rotor in the example fluid system of FIG. 2A.

FIG. 2B is a side cross-sectional view of a fluid inlet portion and the magnetic coupling 258 between an electric machine rotor 220 and a fluid end rotor 206 in an example fluid system 200 of FIG. 2A. Permanent magnets 236*a*, 236*b* are affixed to an inner diameter of electric machine rotor shaft 221 and an outer diameter of the upper end 207 of process fluid rotor 206, respectively. Magnets 236*a*, 236*b* are unitized to their respective rotors by sleeves 237*a*, 237*b*, and those sleeves serve also to isolate the magnets from their respective surrounding environments. Sleeves 237*a*, 237*b* are ideally made of materials and/or are constructed in such a way as to not significantly obstruct the magnetic field of magnetic coupling 258, and to generate little if any heat from e.g. eddy currents associated with the coupling rotating magnetic field. In certain instances sleeves 237*a*, 237*b* can be made from an appropriate non-ferrous metal, e.g. "AISI 316" stainless steel or Inconel, or they can include a fiber-resin composite such as carbon-fiber, ceramic fiber, basalt fiber, aramid fiber, fiber glass, and/or another fiber in e.g. a thermoplastic or thermoset resin matrix. Magnetic fields produced by permanent magnets 236*a*, 236*b* interact across sleeve 235 to magnetically lock (for rotational purposes) electric machine rotor 220 and process fluid rotor 206, thus forming magnetic coupling 258.

Friction between spinning process fluid rotor 206 and fluid inside coupling chamber 244 tends to "drag" the latter along (in the same direction) with the former (and resists motion of the former, consuming energy), but because friction also exists between static sleeve 235 and said fluid (tending to resist fluid motion), the fluid will typically not spin at the same speed as process fluid rotor 206. Centrifugal forces will be established in the spinning process fluid which will cause heavier elements (e.g. solids and dense liquid components) to move outward (toward sleeve 235) while lighter elements (e.g. less dense liquid components and gas that might have been mixed with heavier elements prior to being "spun") will be relegated to a central core, proximate spinning process fluid rotor 206. The described relative motion between mechanical parts and the fluid, and between different components of the fluid, among other phenomena, produces heat that is later removed from coupling chamber 244 by various mechanisms. Fortuitously, less heat will be generated and less energy will be consumed by spinning process fluid rotor 206 if the fluid proximate spinning process fluid rotor 206 has low density and is easily sheared, which are characteristics of gas. Fluid system 100 can supply gas into coupling chamber 244 whenever gas is available from the process stream, e.g. via stub 234 internal axial conduit 242 (and associated conduits). Regardless the properties of fluid within coupling chamber 244, that (made-hot-by-shearing, etc.) fluid may be displaced with cooler fluid to avoid over-heating proximate and surrounding (e.g. motor) components.

The fluid inlet portion of FIG. 2B is located proximate electric machine 202 and magnetic coupling 258. Process fluid enters fluid end 204 by three conduits before being combined immediately upstream of first impeller 241 at the all-inlets flows-mixing area 243. Because none of those three flows (described in greater detail below) are typically sourced downstream of subsea fluid system 200, they have not been acted upon by subsea fluid system 200 and do not constitute a "loss" for purposes of calculating overall system efficiency. The majority of process fluid enters fluid end 204 via main inlet 250. Coupling coolant enters electric machine 202 via a port 245 in cap 233, and is directed to coupling chamber 244 by conduit 242. Coolant for radial bearing 264*a* enters through port 260 to join gallery 262, from which it is directed through ports 251 to bearing chamber 247. For the purpose of the current discussion, process fluid entering fluid end 204 shall be assumed to come from a common source proximate subsea fluid system 200 (not shown in FIG. 2A), and therefore the pressure in main inlet gallery 252, coupling chamber 244 and bearing chamber 247 may be assumed to be approximately the same. The mechanism that causes fluid to enter fluid end 204 via ports 260 and 245 with slight and "tunable" preference to main inlet 250 is the pressure drop created by inlet homogenizer 249. Pressure inside inlet flow homogenizer chamber 251, and therefore coolant flows mixing chamber 253 (by virtue of their shared influence via the all-inlets flows-mixing area 243) is lower than the source of all inlet flows, which creates a pressure field sufficient to create the desired cooling flows.

For fluid in coupling chamber 244 to reach coolant flows mixing chamber 253 it traverses bearing 264*a*. It does so via bypass ports 269 provided in cage ring 268. For fluid in bearing chamber 247 to reach coolant flows mixing chamber 253, it first exits chamber 247 by either of two routes. Most fluid exits chamber 247 through the clearance gap between the upper, inner bore of cage ring 268 and the outside diameter of rotor sleeve 267. Once in coupling chamber 244 it mingles with the coupling cooling fluid and reaches the coolant flows mixing chamber via bypass ports 269.

Fluid may also exit bearing chamber 247 by way of seal 256 to emerge in coolant flows mixing chamber 253. Seal 256 is a type of highly effective hydrodynamic rotating mechanical seal known to those skilled in the art. Seal 256 is described more fully in relation to seal 282 associated with sump top plate 280. Seal 256 has a much smaller clearance relative to rotor sleeve 267 than does cage ring 268 (located at the top of bearing 264*a*), and has a much lower leakage rate as a result. This configuration encourages fluid entering bearing chamber 247 to exit there-from at the upper end of bearing 264*a*. That bias in-combination with gravity and centrifugal forces pushing heavier fluid components (e.g. liquids) down and radially outward, respectively, also causes any gas that might be entrained in the fluid stream entering bearing chamber 247 to move radially inward so that it is exhausted immediately past cage ring 268.

Keeping gas out of bearing chamber 247 and removing it quickly should it come to be present in bearing chamber 247 will promote good performance and long life for fluid-film bearing 264*a*. To increase the likelihood that bearing 264*a* active surfaces are constantly submerged in liquid (i.e. inside surfaces of tilt-pads 266 and outside surface of rotor sleeve 267 adjacent to tilt-pads 266), tilt-pads 266 are positioned to interact with rotor sleeve 267 on a larger diameter than the gaps (above and below tilt-pads 266) that allow fluid to move out of bearing chamber 247. The natural tendency for gas to separate from liquid and move toward the center of rotation in a rotating fluid system will ensure gas moves out of bearing chamber 247 in advance of liquids whenever gas is presented within bearing chamber 247.

In some embodiments of subsea fluid system 200, process fluid combined immediately upstream of first impeller 241 at the all-inlets flows-mixing area 243 is downstream-thereof increased in pressure by hydraulic stages including impellers secured to process fluid rotor 206 interacting with interspersed static diffusers (a.k.a. stators). Static and dynamic seals are provided at appropriate locations within the hydraulic stages to minimize back-flow from higher-to-lower pressure regions, thereby improving the hydraulic performance of fluid end 204.

Figure 2C:
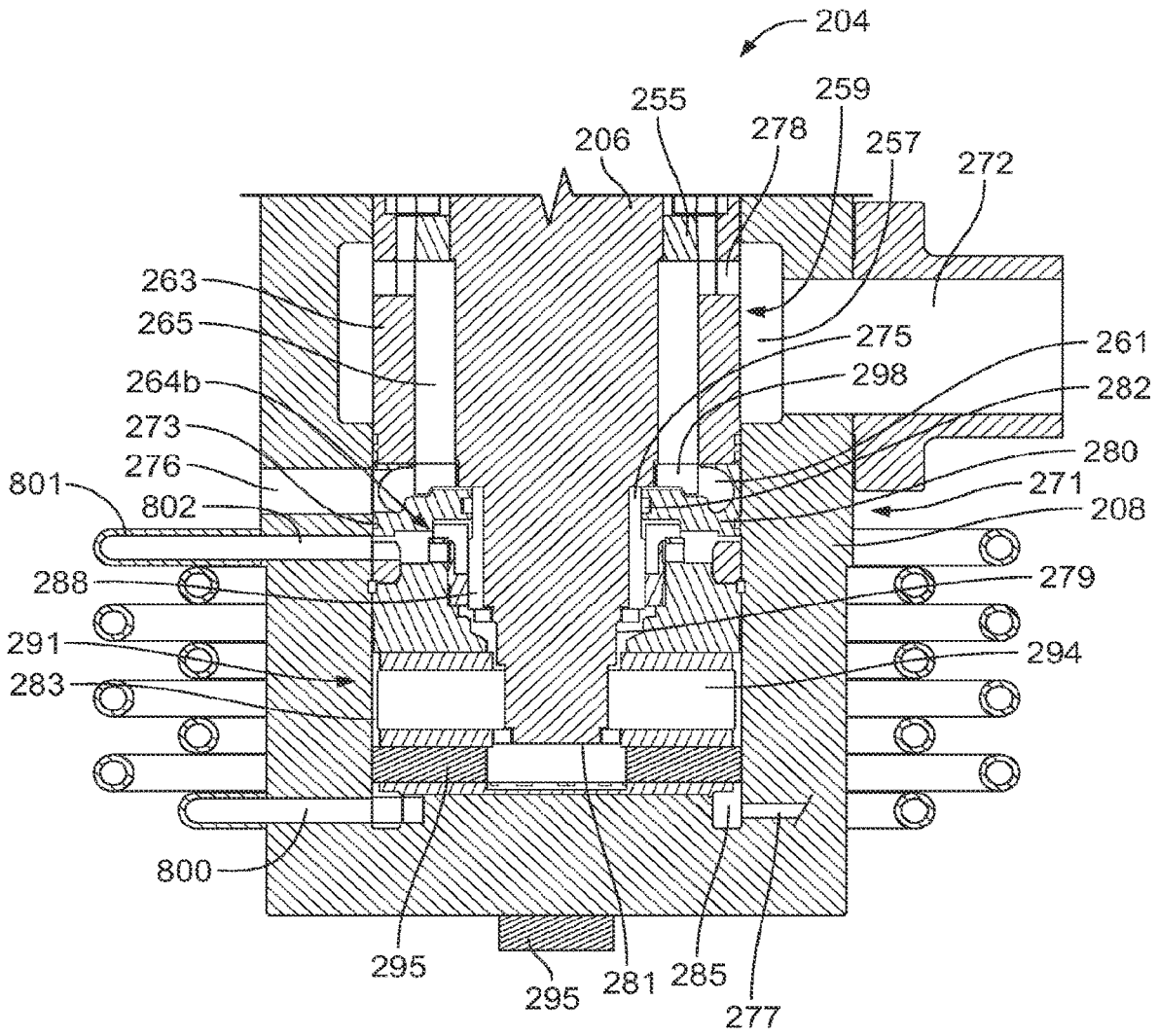
FIG. 2C is a side cross-sectional view of a fluid outlet portion and sump of the example fluid end of FIG. 2A.

FIG. 2C is a side cross-sectional view of a fluid outlet portion and sump of an example fluid end 204 of FIG. 2A. There are five main regions of interest in this area separated by two significant functional elements. Those elements are process fluid rotor 206 thrust balance device 259 and sump top plate 280. Above, surrounding and below thrust balance device 259 are final-stage impeller 255, fluid end 204 outlet gallery 257, and balance circuit outlet device 261 (shown in FIG. 2C as integrated with sump top plate 280, which is not a strict requirement), respectively. Above and below sump top plate 280 are balance circuit outlet device 261 and sump 271, respectively.

The highest pressure in certain embodiments of subsea fluid system 200 may occur immediately downstream of final-stage impeller 255. By passing through openings 278 provided in balance device stator 263, process fluid enters outlet gallery 257 at a slightly lower pressure, and exits into process fluid outlet 272 which is connected to a downstream pipe system. Total pressure change from final-stage impeller 255 to the point of entry to the downstream pipe may be a reduction (small, if e.g. care is taken in design of balance device stator 263 fluid paths 278, volute geometry is provided in outlet gallery 257, and the transition from outlet gallery 257 is carefully contoured, etc.) or an increase (for some embodiments with some fluids for a well-executed volute).

When subsea fluid system 200 is not operating, i.e. when process fluid rotor 206 is not spinning, fluid entering fluid end housing 208 at inlet 250 and flowing past the hydraulics stages (impellers/diffusers) to exit through outlet 272 will impart relatively little axial force on process fluid rotor 206. When process fluid rotor 206 is spinning, the interaction of the impellers, diffusers and associated components creates pressure fields that vary in magnitude depending on local fluid properties existing at many physical locations within fluid end 204. Those multiple-magnitude pressure fields act on various geometric areas of process fluid rotor 206 to produce substantial thrust. Such thrust generally tends to drive process fluid rotor 206 in the direction of inlet 250, however various operating scenarios may produce "reverse thrust". Depending on thrust magnitude and direction, thrust bearing 291 may possess sufficient capacity to constrain process fluid rotor 206. In the event thrust acting on process fluid rotor 206 exceeds the capacity of a practical thrust bearing 291, considering the many complex tradeoffs known to those skilled in the art of fluid ends design, a thrust balance device 259 may be used. Thrust bearing 291 is located near the lower end of fluid end housing 204. Thrust bearing 291 includes an upward-facing bearing surface on thrust collar 294 (coupled to fluid rotor 206), and downward-facing bearing surfaces on e.g. tilt-pads anchored to fluid end housing 208, the bearing surfaces cooperating to resist the upward thrust of fluid rotor 206. Similar components and associated surfaces are provided on the opposite side of thrust collar 294 to resist "reverse thrust" and other scenarios causing fluid rotor 206 to tend to move downward.

Various types of thrust balance devices are known, with the two most common being referred to as "disk" and "piston" (or "drum") types. Each type of device has positive and negative attributes, and sometimes a combination of the two and/or a different device altogether is appropriate for a given application. Embodiments described herein include a piston-type thrust balance device; however, other types may be implemented.

A piston-type thrust balance device is essentially a carefully-defined-diameter radial-clearance rotating seal created between process fluid rotor 206 and a corresponding interface to generate a desired pressure-drop by exploiting pressure fields already existing in fluid end 204 to substantially balance the thrust loads acting on process fluid rotor 206. The thrust balance device includes two main components (not including process fluid rotor 206), however a fluid conduit (balance circuit conduit 276) connecting the low pressure-side of thrust balance device 259 to inlet 250 pressure is also provided. Balance device rotor 265 is secured to process fluid rotor 206 in a way that provides a pressure-tight seal there-between. Balance device stator 263 is secured to fluid end housing 208 via sealed interfaces with other components. A small clearance gap is provided between balance device rotor 265 and stator 263 to establish a "rotating seal." High pressure from final-stage impeller 255 acts on one side of balance device rotor 265 while low pressure corresponding to that in inlet 250 acts on the other side. Inlet 250 pressure is maintained on the low pressure side of balance device 259 despite high pressure-to-low pressure fluid leakage across the clearance gap (between the balance device rotor 265 and stator 263) because such leakage is small compared to the volume of fluid that can be accommodated by balance circuit conduit 276. Balance circuit outlet device 261 collects and redirects fluid exiting balance device 259 to deliver it to balance circuit conduit 276. The nominal diameter of the clearance gap (which defines the geometric areas on which relevant pressures act) is selected to achieve the desired degree of thrust imbalance (note that some imbalance is valuable from bearing loading and rotor dynamic stability perspectives).

Returning briefly to thrust bearing 291, the side that is normally loaded in operation is referred to as the "active" side (upper side in FIG. 2C), whereas the other side is referred to as the "inactive" side. In certain embodiments, the active side of thrust bearing 291 is protected during high-risk long-term storage, shipping, transportation, and deployment activities by maintaining it "un-loaded" during such activities. Specifically, process fluid rotor 206 "rests" on inactive side of thrust bearing 291 whenever subsea fluid system 200 is not operating, e.g. during storage, handling, shipping and deployment. This arrangement is advantageous because design attributes that increase tolerance to e.g. high impact loads during deployment, which however might reduce normal operating capacity, can be implemented for the inactive side of thrust bearing 291 without affecting the operating thrust capacity of fluid end 204. Such design attributes (among others) may include selection of bearing pad materials that are tolerant of prolonged static loads and/or impact loads, and that however do not have highest-available operating capacity. In addition, energy absorbing features e.g. springs, compliant pads (made of elastomeric and/or thermoplastic materials, etc.) and/or "crushable" devices (ref. "crumple zones" in automobiles) may be added integral to and/or below thrust bearing 291, as well as external to fluid end housing 208 (including on skid and/or on shipping stands, running tools, etc.). It may also be advantageous to "lock" rotors 206, 220 so that they are prevented from "bouncing around" during e.g. transportation, deployment, etc., or to support them on "stand-off" devices that prevent e.g. critical bearing surfaces from making contact during such events. Such locking and stand-off functionality may be effected using devices that may be manually engaged and/or released (e.g. locking screws, etc.), or preferably devices that are automatically engaged/disengaged depending on whether rotors 206, 220 are stopped, spinning, transitioning-to-stop or transitioning-to-spin. Devices providing aforementioned attributes include permanent magnet and/or electro-magnet attraction devices, among others ("locking" devices), and bearing-like bushings or pad/pedestal-like supports, among others, that present geometry suitable to the stand-off function while rotors 206, 220 are not spinning and present e.g. "less intrusive" geometry that permits the bearings (intended to support rotors 206, 220 during operation) to affect their function when rotors 206, 220 are spinning ("stand-off" devices). Displacement mechanisms that might enable the "dual-geometry" capability desired for "stand-off" devices include mechanical, hydraulic, thermal, electric, electro-magnetic, and piezo-electric, among others. Passive automatic mechanisms for enacting the locking and/or stand-off functions may be used, however a control system may also be provided to ensure correct operation.

Sump top plate 280 in combination with seals 282 and 273 substantially isolate sump 271 fluid from interacting with fluid end 204 process fluid. Sump 271 contains fluid-film type radial bearing 264*b* and thrust bearing 291. To enable good performance and long service life, fluid-film bearings are lubricated and cooled with clean liquid, and process fluid (especially raw hydrocarbon process fluid) may contain large volumes of gas and/or solids that could harm such bearings.

Seal 282 may be substantially the same as seal 256 associated with upper radial bearing 264*a* described previously. Seal 282 is secured to sump top plate 280 and effects a hydrodynamic fluid-film seal (typically micro-meter-range clearance) relative to rotor sleeve 275 (shown in FIG. 2C as integrated with bearing sleeve 288, which is not a strict requirement) when process fluid rotor 206 is spinning, and also a static seal (typically zero-clearance) when process fluid rotor 206 is not spinning. Seal 282 may be designed to maintain, increase or decrease its hydrodynamic clearance when subjected to differential pressure transients from either side (above or below), and therefore to substantially maintain, increase or decrease, respectively, its leakage rate during especially sudden pressure transients. Seal 282 includes features enabling its hydrodynamic performance that allow a small amount of leakage in dynamic (regardless the clearance magnitude relative to rotor sleeve 275) and static modes whenever it is exposed to differential pressure, and therefore it may for some applications be characterized as a flow-restrictor instead of an absolute seal. A small amount of leakage is desired for the sump 271 application.

Prior to deployment, and using port(s) 277 provided for such purpose (as well as for refilling sump and/or flushing sump of gas and/or debris, etc.), sump 271 may be filled with a fluid having attractive properties for the target field application, e.g. chemically compatible with process fluid and chemicals that might be introduced into process stream and/or sump 271, density greater than process fluid, useful viscosity over wide temperature range, good heat-transfer performance, low gas-absorption tendency, etc. Following installation and upon commissioning (during which time subsea fluid system 200 is operated), fluid end 204 will be pressurized in accordance with its design and sump 271 temperature will rise significantly, the latter causing sump fluid to expand. The ability of Seal 282 to transfer fluid axially in both directions ensures pressure in sump 271 will not rise significantly as a result, and further ensures that pressure in sump 271 will substantially match fluid end 204 inlet 250 pressure during operating and non-operating states, except during process fluid rotor 206 axial position transients (explained below).

The low-leakage-rate, static sealing and hydrodynamic sealing capabilities of seal 282, combined with an otherwise "sealed" sump 271, provide unique and valuable attributes to fluid end 204. Seal 282 provides a low leakage rate even when subject to sudden high-differential pressure, and therefore equalizes pressure more or less gradually depending mainly on the initial pressure differential and properties of fluid involved (e.g. liquid, gas, multiphase, high/low viscosity, etc.). In one scenario, prior to starting to spin process fluid rotor 206, an operator may inject liquid into port 277 at a rate sufficient to create a pressure differential across seal 282 adequate to elevate process fluid rotor 206, thereby avoiding the rotor dynamic instability that might accompany transitioning from the "inactive" side of thrust bearing 291 (not normally used) to the "active" side (used during normal operations) upon start-up. In another scenario, almost the reverse process may be employed. That is, prior to stopping rotation of process fluid rotor 206, liquid may be injected into port 277 at a rate sufficient to maintain elevation thereof. Upon shut-down, process fluid rotor 206 will continue to be elevated until it has ceased to spin, at which point liquid injection through port 277 can be halted to allow process fluid rotor 206 to land softly, without rotation, onto the inactive surfaces of thrust bearing 291. That will reduce damage potential and thereby promote long bearing life. In another scenario, any tendency to drive process fluid rotor 206 into sump 271 ("reverse thrust") will encounter "damped resistance" owing to the fact fluid must typically bypass seal 282 (which happens only slowly) in order for process fluid rotor 206 to move axially. Similar resistance will be encountered if process fluid rotor 206 is motivated to rise quickly from its fully-down position, however fluid passes seal 282 to enter sump 271 in that case. The foregoing "damped-axial translation" attribute will protect thrust bearing 291 and thereby promote long-life for subsea fluid system 200. In another scenario, in the event process gas permeates sump fluid, and inlet 250 (which dictates sump nominal pressure) is subsequently subject to a sudden pressure drop, seal 282 will only gradually equalize sump pressure to the lower inlet 250 pressure and thereby prevent a sudden expansion of sump gas that might otherwise evacuate the sump. This is a scenario for which designing seal 282 to "reduce its clearance relative to rotor sleeve 275 when subject to differential pressure transients" (described previously) may be applicable. As noted previously, maintaining liquid in sump 271 will facilitate the health of bearings 264*b*, 291. In any scenario that potentially subjects spinning process fluid rotor 206 to "reverse thrust", pressure higher than at-that-time-present in inlet 250 (and therefore sump 271) may be applied to sump port 277 to resist such "reverse-thrust" and thereby protect e.g. the inactive-side elements of thrust bearing 291. A substantial sensor suite and associated fast-acting control system, possibly including automation algorithms, actuated valves and high pressure fluid source may be used to effect the "process fluid rotor active shaft thrust management" functionality herein described. It shall be understood that similar ability to apply pressure to the top of process fluid rotor 206 (e.g. via gas conduit 109) may be developed to provide sophisticated "active thrust management" for fluid end 204.

Significant heat will be generated in sump 271 caused by fluid-shear and other phenomena associated with spinning process fluid rotor 206 and attached thrust collar 294. Cooling sump fluid to optimize its properties for maintenance of bearing performance is achieved by circulating the fluid through a heat exchanger 801 positioned in water surrounding fluid end 204. Careful positioning of flow paths in and around bearings 264*b*, 291, and for heat exchanger 801 inlet and outlet ports (800 and 802, respectively), combined with naturally occurring convection currents and aided by e.g. volute-like geometry in sump lower cavity 285, will create a "pumping effect" for sump 271. Such pumping effect can be enhanced by adding features, e.g. "scallops", "helixes", "vanes", etc., to the outside of rotating elements including process fluid rotor 206 (e.g. at locations 279, 281; latter on the end-face and/or possibly on an extension of process fluid rotor 206) and/or thrust collar 294 (e.g. at location 283). Alternatively or in addition, an impeller or similar device may be attached to the lower end of process fluid rotor 206.

It is unlikely that process fluid-borne solids of significant size or volume will make their way into sump 271. As noted previously, sump 271 is normally pressure-balanced with respect to inlet 250 via balance circuit conduit 276, so there is normally no fluid flow between sump 271 and fluid end 204 process fluid-containing areas. Additionally, seal 282 allows only small-volume and low-rate fluid transfer thereacross (even during high differential pressure transients). Furthermore, a convoluted path with multiple interspersed axial and radial surfaces exists between the underside of balance device rotor retainer 298 and the top of sump top-plate 280, so solids must intermittently move upward against gravity and inward against the centripetal force before they can approach the top of seal 282. Regardless, two or more ports 277 may be provided to circulate liquid through sump 271 and/or heat exchanger 801 to effectively flush same, at least one port for supplying fluid and one for evacuating fluid (e.g. to any conduit or vessel located upstream of inlet 250). Ports 277 may be provided to intersect sump lower cavity 285 (as shown in FIG. 2C), which represents a large diameter and the lowest point in sump 271, and also an area where solids are likely to collect. Alternative locations for ports 277 may also be provided, and may provide additional benefits including an ability to deliver high-rate flow of liquids directly into heat exchanger 801 to flush solids and/or gas (should either of the latter become trapped therein). Note that heat exchanger 801 may take many forms in addition to that shown in FIG. 2C, including some optimized for solids removal and/or gas removal.

Returning to FIGS. 1A-D, FIG. 1B is a schematic diagram of an example adjustable speed drive 120 in accordance with the present disclosure. The adjustable speed drive (ASD) 120 includes an ASD housing 128 (also referred to as a second housing). As mentioned above, the ASD housing 128 is in fluid communication with the electric machine housing 210 (e.g., through a conduit 122). The fluid may be a gas at substantially atmospheric pressure when operating at a specified depth. In some implementations, the ASD housing 128 is affixed to the electric machine housing 210. For example, a conduit 122 may reside between the electric machine housing 210 and ASD housing 128 and may provide fluid communication between the electric machine housing 210 and ASD housing 128.

The ASD 120 regulates power for the electric machine 102. Power may be received from a power source through a power source conduit 130. As described above, the submersible well fluid system 100 is adapted to operate submerged at a specified depth in the body of water. The ASD 120 may include an ASD housing 128 that carries electrical components within the ASD housing 128 that is adapted to provide necessary support to the ASD 120 against collapse at the specified depth.

The conduit 122 residing between the electric machine housing 210 and ASD housing 128 provides fluid communication between the electric machine housing 210 and ASD housing 128. A power conductor 124 and/or a control communication line 126 may also reside in the conduit. The power conductor 124 is electrically coupled to the electric machine 102 and the adjustable speed drive 120. The control communication line 126 can facilitate the communication of control signaling between the adjustable speed drive 120 and the electric machine 102.

In some implementations, the adjustable speed drive 120 includes active power factor correcting front end 132 (briefly, active front end 132). The active power factor correcting front end 132 includes an inverter configured to receive alternating current and output direct current. The active power factor correcting front end 132 an input power line filter 133 and an active power factor correcting rectifier 135 configured to switch at a frequency greater than 60 Hertz (Hz). The adjustable speed drive 120 may be provided without an input transformer electrically coupled to a rectifier of the adjustable speed drive. The adjustable speed drive 120 may also include other electronics 134 in accordance with the paragraphs below.

Power utility generators and private party power generators deliver AC power at 50 Hz or 60 Hz. Therefore, typical ASD input transformers operate at those frequencies. To be best optimized a specific transformer would typically be designed for each input frequency. If not optimized, the transformer would be even larger. The active power factor correcting front end 132 can accommodate both input frequencies with the same hardware. The active power factor correcting front end 132 is an inverter connected backwards to the grid. This is achieved by using the active switching components to switch the incoming AC voltage into DC output voltage. The active power factor correcting front end 132 can be designed to "switch" at a much higher frequency (than 50 Hz/60 Hz), with a benefit being that it reduces upstream harmonics more effectively than does a passive transformer. In addition to an active power factor correcting front end 132 being inherently smaller than the passive input transformer and Rectifier it is designed to replace, the associated line-side filters are also much smaller than those required to support a passive transformer.

The active power factor correcting front end 132 facilitates power factor correction to reduce voltage drop in the supply cables, which is advantageous for long step out applications. The active power factor correcting front end 132 achieves this by controlling its active switching devices to control the phase angle between the input voltage waveform and the conductive current, thus controlling the effective load power factor that the input line would experience. The active power factor correcting front end 132 therefore may also be referred to as the Power Factor Correction (PFC) module. By controlling the angle between voltage at its terminal and current in the line, the active power factor correcting front end 132 effectively can supply reactive power to compensate for inductances in the long cables, thus reducing the voltage drop impact of typical long umbilical cables.

The lead angle can also be adjusted with the PFC circuit to optimize for different cable lengths. In a rectified input for example, a large passive circuit needs to be used to create this offset, while our active power factor correcting front end 132 is doing this algorithmically. This also allows us to "adjust" our system through software to different sites or umbilical lengths instead of changing the circuit in hardware as in the rectified solution. An active PFC combined in a back-to-back converter topology can also allow "back-driving" the grid in the event of a stopping of the motor by generation (this bidirectional power flow is another advantage that can be leveraged).

In some implementations, the adjustable speed drive 120 is cooled only by passive cooling, for example, by the temperature of the body of water in which it is submerged. In some implementations, the adjustable speed drive can be adapted to transfer heat generated during operation substantially by conduction through the ASD housing 128 to the body of water. The adjustable speed drive 120 may support electrical components in contact with the interior of the ASD housing 128, which can be cooled passively. Cooling for various components is achieved substantially by passive conduction through the external housing to the surrounding water. Active cooling features, such as fans or pumped-liquids, can be omitted, and therefore, there is no requirement for large clearances and/or fluid-conduits.

The submersible well fluid system may include one or both of the barrier fluid supply system 300 and the chemical distribution system 140, depending on the implementation. FIGS. 1C—G illustrate more details about the barrier fluid supply system 300 and the chemical distribution system 140.

FIG. 1C is a schematic diagram of a chemical distribution system 140 and a pressure management system 160 of the submersible well fluid system 100 of FIG. 1A. FIG. 1D is a schematic diagram showing a close-up view of the fluid end 104 of the submersible well fluid system 100 of FIG. 1A. FIGS. 1C—D are discussed in conjunction with one another in more detail below.

In some implementations, the submersible well fluid system 100 may include a chemical distribution system 140 adapted to couple to a submerged treatment chemical storage tank 141 and provide a treatment chemical from the submerged treatment chemical storage tank 141 to one or more locations of the submersible well fluid system 100. The system may use one or more of a plurality of treatment chemicals, which each may be stored in treatment chemical storage tanks 141 in fluid communication with the submersible well fluid system 100 upstream of the process fluid outlet 114. The treatment chemical storage tanks 141 may be on the sea floor or may be suspended under the surface of the body of water. The treatment chemical may be a process treatment chemical. The treatment chemicals may include one or more of a hydrate inhibitor, a wax inhibitor, a scale inhibitor, a foam inhibitor, or a corrosion inhibitor.

The chemical distribution system 140 may include the submerged treatment chemical supply tank 141, or may be treated separately, and the treatment chemical is provided by a mechanisms In certain implementations, the chemical distribution system is integrated with a first housing 210 that houses the electric machine 102.

The chemical distribution system 140 may include a manifold 142 adapted to direct the treatment chemical in the chemical storage tank 141 to one or more locations upstream of the process fluid outlet 114. The manifold 142 includes one or more valves 146 that can be selectively operated to allow the one or more treatment chemicals to enter various portions of the submersible well fluid system 100. The valves 146 allow the treatment chemical to be directed to the fluid end 104 of the submersible well fluid system 100.

In some implementations, the chemical distribution system 140 includes a manifold 142 configured to receive a chemical from the submerged treatment chemical storage tank 141 and distribute the chemical to the one or more locations of the submersible well fluid system 100. The one or more locations of the submersible well fluid system 100 includes the fluid end 104, a pressure management system 160, or at a location of the submersible well fluid system 100 upstream of the process fluid outlet 114.

For example, the treatment fluid can be directed through the valves 146 into a bellows chamber 163. From the bellows chamber 163, the treatment fluid can be directed through a heat exchanger conduit 147 and into the heat exchanger 148. The heat exchanger 148 can cool fluids from the heat exchanger conduit 147. The cooled fluid can be introduced to the fluid end 104 through cooled fluid line 149. The cooled fluid can enter the fluid end 104 at different areas, as shown in FIG. 1D.

FIG. 1D is a schematic diagram showing a close-up view of the fluid end 104 of the submersible well fluid system 100 of FIG. 1A. The cooled fluid from the heat exchanger 148 can be introduced to the fluid end 104 through the cooled fluid line 149. Cooled fluid line 149 can branch off to two directions. The cooled fluid can enter the fluid end 104 through a first inlet 166 via a first fluid line 165. The first inlet 166 allows the fluid to contact the seals separating the electric machine 102 from the fluid end 104. The fluid from the top seals can be directed to the bottom of the fluid end 104 via line 167 and inlet 168, where it can enter the bottom of the fluid end 104 to provide cooling fluid to the support pads. The cooling fluid can then be directed out of the fluid end and back to the heat exchanger through a line 150.

Cooled fluid from the heat exchanger 148 can also be directed to the fluid end 104 by inlet 169. The cooled fluid can then cool seals 256 and tilt pads at the bottom of the impeller. The cooled fluid in this portion of the fluid end 104 can then be directed out to the heat exchanger on the line 150.

The fluid from the fluid end 104 can be directed back to the bellows chamber 163 via line 150. In some implementations, the treatment fluid can be introduced to the fluid end 104 through line 150 without entering the heat exchanger 148 and allows the fluid to be introduced to the fluid end 104 faster.

Returning to FIG. 1D, in some implementations, the chemical distribution system 140 includes an accumulator 152 that can store a chemical (e.g., a hydrate inhibitor) under a positive pressure (e.g., by storing an inert gas, such as nitrogen or argon). In the event of an unplanned system-wide shutdown, the chemical can be released from the accumulator 152 into the submersible well fluid system 100 upstream of the process fluid outlet 114. For example, the hydrate inhibitor is used to prevent or remove the formation of hydrates (ice crystals) in the submersible well fluid system 100 that may form when the submersible well fluid system 100 is submerged at operational depth but undergoes an unplanned shutdown. The hydrate inhibitor can be delivered to the accumulator 152 from one of the storage tanks 141. The hydrate inhibitor can be delivered to the accumulator through the valve header 158, through valves 154, 155, and 157. The accumulator can be coupled to the manifold 142 through a coupling 156. When the hydrate inhibitor is needed, the valves 154, 155, and 157 can be opened to allow the hydrate inhibitor to flow to the valve header 158, where it can be distributed to the fluid end 104 and elsewhere through the manifold 142 of the chemical distribution system 140.

Figure 3A:
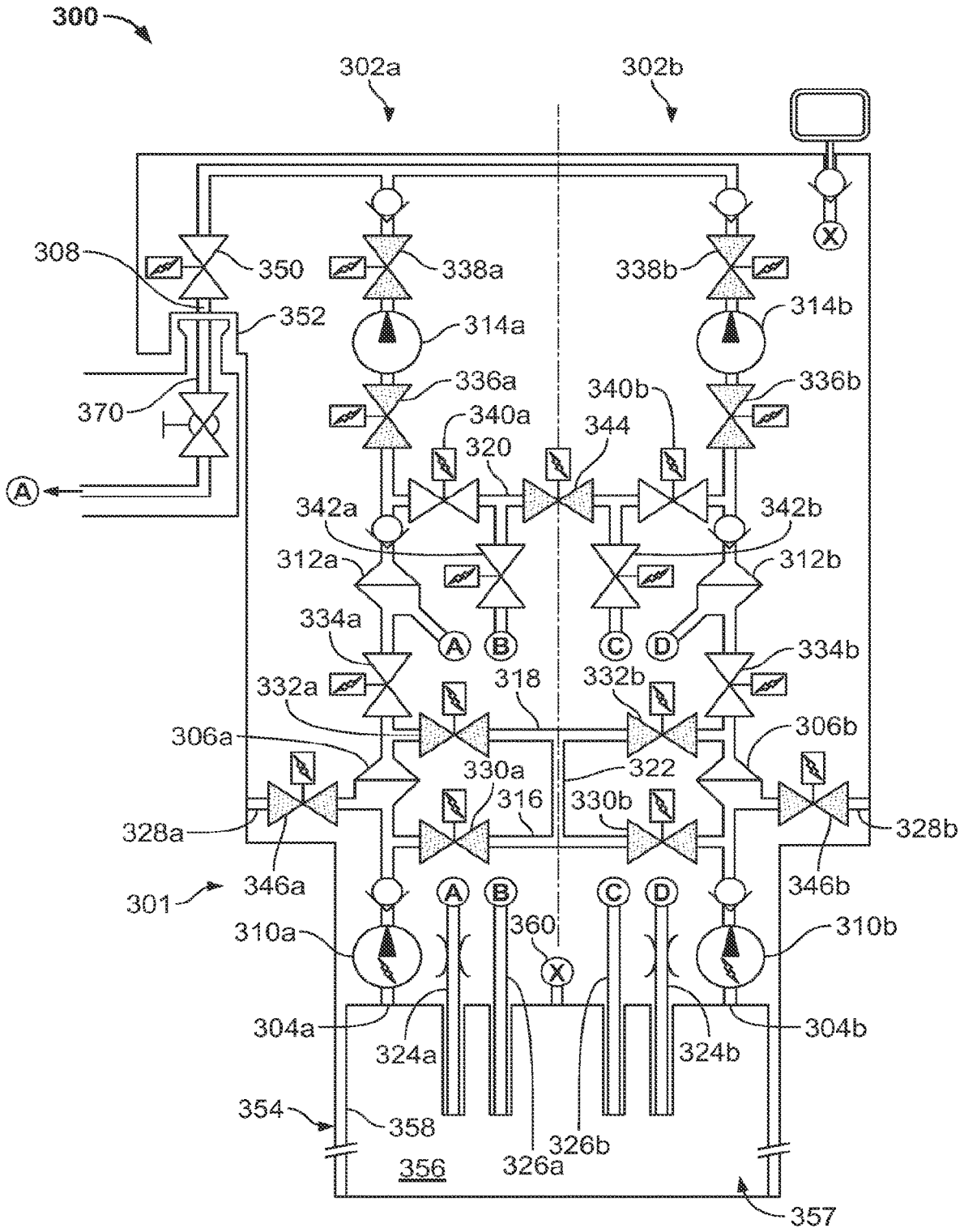
FIG. 3A is a schematic diagram showing a close-up view of the barrier fluid supply system of the submersible well fluid system of FIG. 1A.

FIG. 3A is a schematic diagram showing a barrier fluid supply system 300 of the submersible well fluid system 100 of FIG. 1A. In general, the barrier fluid supply system 300 may be adapted to supply a barrier fluid to the fluid end 104. In some implementations, the fluid end 104 may include rotating seals and fluid film bearings (as described above in FIGS. 2A—C). The barrier fluid supply system 300 can be adapted to supply a barrier fluid to the fluid end 104. For example, the barrier fluid can isolate the components of the fluid end 104 from the process fluid. For example, the barrier fluid can resist leakage of the process fluid across the rotating seals 256. Likewise, the barrier fluid can be supplied to a fluid film bearing in the fluid end 104. The barrier fluid supply system 300 may be connected to the fluid end 104 through a heat exchanger 148 in fluid communication with the fluid end 104 in a similar manner as the chemical distribution system 140 described above. Accordingly, the barrier fluid can be directed to portions of the fluid end 104 that contain the rotating seals 256 and the fluid film bearing.

The barrier fluid supply system 300 for the submersible well fluid system 100 for operating submerged in a body of water may itself be submersible. The barrier fluid supply system 300 may include two "redundant" sets of components, referred to below as a first fluid circuit 302*a* and a second fluid circuit 302*b*. The circuits may be operated individually, in tandem, or interactively (i.e., fluid may flow from the first fluid circuit to the second fluid circuit and vice versa). Each circuit may include the same components, and like reference numbers indicate like components. For example, the barrier fluid supply system 300 may include an inlet 304*a*/304*b* adapted to intake a barrier fluid, a filter 306*a*/306*b* in communication with the inlet 304*a* adapted to filter the barrier fluid, and a barrier fluid outlet 308 in communication with the filter 306*a*/306*b* adapted to couple to a barrier fluid inlet 370 of the submersible fluid system 100 and supply the filtered barrier fluid to the barrier fluid inlet 370 of the submersible fluid system 100. In some implementations, the barrier fluid inlet 370 of the submersible fluid system 100 is in fluid communication with the bellows chamber 163, shown in e.g. FIG. 1C.

A filter may be coupled to the inlet 304*a,b* and adapted to filter the collected water. The filter may include a multistage filter that includes a coarse filter 306*a,b* (e.g., 50 μm filter size or perhaps smaller) that can be used to filter out particles and other matter that is neutrally buoyant (i.e., particles that may not settle out naturally in the quiescent chamber). The filter may also include a reverse osmosis (RO) membrane 312*a,b* (fine filter) downstream of the coarse filter for filtering microscopic particles and molecules that may be in or interacting with the water (e.g., bacteria, salt, other minerals, etc.). The RO membrane 312*a,b* can remove impurities having sizes on the order of 1 Å. The RO membrane 312*a,b* be fluidically coupled to a reject passage 326*a,b* that permits water circulation back to the solids settling chamber 356 and to aid in filtering and maintenance of the RO membrane 312*a,b*.

In some implementations, the barrier fluid supply system 300 may include a water treatment system 301, shown in FIG. 3A. The barrier fluid inlet 304*a,b* described briefly above may include a water inlet adapted to intake water from the surrounding body of water. The water treatment system treats the surrounding water for use as the barrier fluid. In some implementations, the barrier fluid includes unfiltered water.

The submersible barrier fluid supply system 300 may include a (low pressure) pump 310*a,b* configured to move fluid from the inlet 304*a,b* to the barrier fluid outlet 308 and, in some implementations, across the filter 306*a,b*. A membrane 312*a,b* downstream of the filter 306*a,b* may be configured to further filter the barrier fluid. A (high pressure) pump 314*a,b* downstream of the membrane 312*a,b* may be configured to move fluid that has passed through the membrane 312*a,b* to the barrier fluid outlet 308. A reject passage 324*a,b* may be fluidically coupled to an upstream side of the membrane 312*a,b* and configured to direct fluid that has not passed through the membrane 312*a,b* to a solids settling chamber 356. A return passage 326*a,b* downstream of the membrane 312*a,b* and configured to direct fluid that passes through the membrane 312*a,b* to the body of water. For example, when water is not required for the submersible well fluid system 100, water can be returned to the solids settling chamber 356.

The water treatment system 301 includes two fluid "circuits" that can operate together or independently to receive water, treat the water, and introduce the water to the submersible well fluid system 100. For example, the submersible barrier fluid supply system 300 may include a first fluid circuit 302*a* that includes the first mentioned filter 306*a* (coarse filter) and a second fluid circuit 302*b*. The second fluid circuit 302*b* may be in fluidic parallel to the first fluid circuit 302*a* and includes a second filter 306*b* (coarse filter). The submersible barrier fluid supply system 300 may include a crossover passage 316, 318, 320 fluidically coupling the first fluid circuit 302*a* and the second fluid circuit 302*b*.

For example, crossover passage 316 may be adapted to communicate fluid in the first fluid circuit 302*a* to the second filter 306*b* to be filtered by the second filter 306*b*.

In some implementations, the submersible barrier fluid supply system may include a first pump 310*a* in the first fluid circuit 302*a*. A crossover passage is adapted to communicate fluid from the first fluid circuit 302*a* to the second fluid circuit 302*b*. The fluid in the second fluid circuit 302*b* may be pumped by the first pump 310*a* of the first fluid circuit 302*a*.

In some implementations, the first fluid circuit 302*a* may include a first pump 310*a* and the second fluid circuit may include a second pump 310*b*. The submersible barrier fluid supply system may include a first crossover passage 316 fluidically coupling the first fluid circuit 302*a* and the second fluid circuit 302*b* downstream of the first and second pumps 310*a,b*, respectively, between the pumps 310*a,b* and the first mentioned filter 306*a* and second filter 306*b*. A second crossover passage 318 may fluidically couple the first fluid circuit 302*a* and the second fluid circuit 302*b* at a location downstream of the first mentioned filter 306*a* and the second filter 306*b*.

In some implementations, the first circuit 302*a* includes a low pressure pump 310*a* upstream of the first mentioned filter 306*a* and a high pressure pump 314*a* downstream of the first mentioned filter 306*a*. In some implementations, the second circuit 302*b* includes a low pressure pump 310*b* upstream of the second filter 306*b* and a high pressure pump 314*b* downstream of the second filter 306*b*.

In some implementations, the submersible barrier fluid supply system may include a clean-out circuit. The clean-out circuit may include a bypass crossover passage 318 fluidically coupling the first fluid circuit 302*a* and the second fluid circuit 302*b* downstream of the first mentioned filter 306*a* and the second filter 306*b*. The bypass crossover passage 318 may be configured to supply a back flush flow of fluid to the filter 306*b*. A reject passage 328*b* maybe fluidically coupled to a passage between the inlet 304*b* and the second filter 306*b* to receive the back flush flow of fluid from the second filter 306*b*. A reject valve 346*b* may control the flow through the reject passage 328*b*. A similar clean-out circuit would likewise exist for filter 306*a*. A reject passage 328*a* may fluidically couple to a passage between the inlet 304*a* and the first mentioned filter 306*a* to receive the back flush flow of fluid from the first mentioned filter 306*a*. A reject valve 346*a* can control the flow of fluid through the reject passage 328*a*. The reject passages 328*a,b* are configured to direct the back flush flow to the body of water.

The submersible barrier fluid supply system 300 includes a clean-out circuit. The clean out circuit may include a bypass crossover passage 318 fluidically coupling the first fluid circuit 302*a* and the second fluid circuit 302*b* downstream of the first mentioned filter 306*a* and the second filter 306*b*. The bypass crossover passage 318 may be configured to supply a back flush flow of fluid to the second filter 306*b*. A reject passage 328*b* may be fluidically coupled to a passage between the inlet 304*b* and the second filter 306*b* to receive the back flush flow of fluid from the second filter 306*b*.

The submersible barrier fluid supply system 300 may also include a reject passage 328*a* fluidically coupled to a passage between the inlet 304*a* and the first mentioned filter 306*a* to receive the back flush flow of fluid from the first mentioned filter 306*a*. The a reject passage 328*a,b* may be fluidically coupled to a passage between the inlet 304*a,b* and the first mentioned filter 306*a* or second filter 306*b*, respectively, to receive fluid from the inlet 304*a,b* and direct it to the body of water.

Some implementations may include a redirect passage 322 fluidically coupling the first crossover passage 316 and the second crossover passage 318, the redirect passage 322 configured to direct fluid in the second crossover passage 318 downstream of the first mentioned filter 306*a* to the first crossover passage 316 upstream of the second filter 306*b*.

The submersible barrier fluid supply system 300 may include an elongate housing 354 internally defining a solids settling chamber 356 exterior to and around the water inlet 304*a,b*. The housing 354 may include a housing water inlet 357 adapted to intake water from the surrounding body of water into the solids settling chamber 356. In certain implementations of the submersible barrier fluid supply system 300, the housing 354 is adapted to cause water in the solids settling chamber 356 to be more substantially quiescent than the surrounding body of water. (The solids settling chamber 356 may thus be referred to as a quiescent chamber 356.) The sidewalls 358 of the housing 354 may be solid and unapertured to facilitate the quiescence.

The submersible barrier fluid supply system may include a clean-out circuit. The clean out circuit may include a bypass passage 318 fluidically coupled to a passage between the first mentioned filter 306*a,b* and the barrier fluid outlet 308 to supply a back flush flow of fluid the filter 306*a,b*. A reject passage 328*a,b* may be fluidically coupled to a passage between the inlet 304*a,b* and the first mentioned filter 306*a,b* to receive the back flush flow of fluid from the filter 304*a,b*.

In some implementations, the submersible barrier fluid supply system includes an inlet 304*a,b* adapted to intake a barrier fluid from the body of water and a barrier fluid outlet 308 in communication with a barrier fluid inlet 370 of the submersible fluid system 100. The barrier fluid outlet 308 is configured to supply the barrier fluid from the body of water to the barrier fluid inlet 370 of the submersible fluid system 100. The submersible barrier fluid supply system may also include a filter 306*a,b* downstream of the inlet 304*a,b* and configured to filter the barrier fluid.

In some implementations, the barrier fluid outlet 308 is in fluid communication with a bellows chamber 163 (shown in FIG. 1C). The bellows chamber 163 includes a bellows 161. The submersible barrier fluid supply system 300 is configured to supply barrier fluid to the bellows chamber 163 upon expansion of the bellows 161. A bias spring 162 may be configured to bias the bellows 161 to expand. The submersible barrier fluid supply system 300 may be configured to supply barrier fluid to one or more seals 256 (shown in FIG. 2B) of a fluid end 104 of the submersible well fluid system 100. In some implementations, the barrier fluid is maintained at a pressure higher than the process fluid at a process fluid inlet of the fluid end 104.

FIGS. 3B-G show example operational scenarios for the barrier fluid supply system of FIG. 3A. Active valves are shown in white, while inactive valves are shaded. It is understood, however, that in some cases, a valve may be open and inactive, depending on where it is and/or depending on the state of the valve. For example, the health of a valve may prompt that switching the valve be minimized. Arrows denote the path the fluid is taking.

Figure 3B:
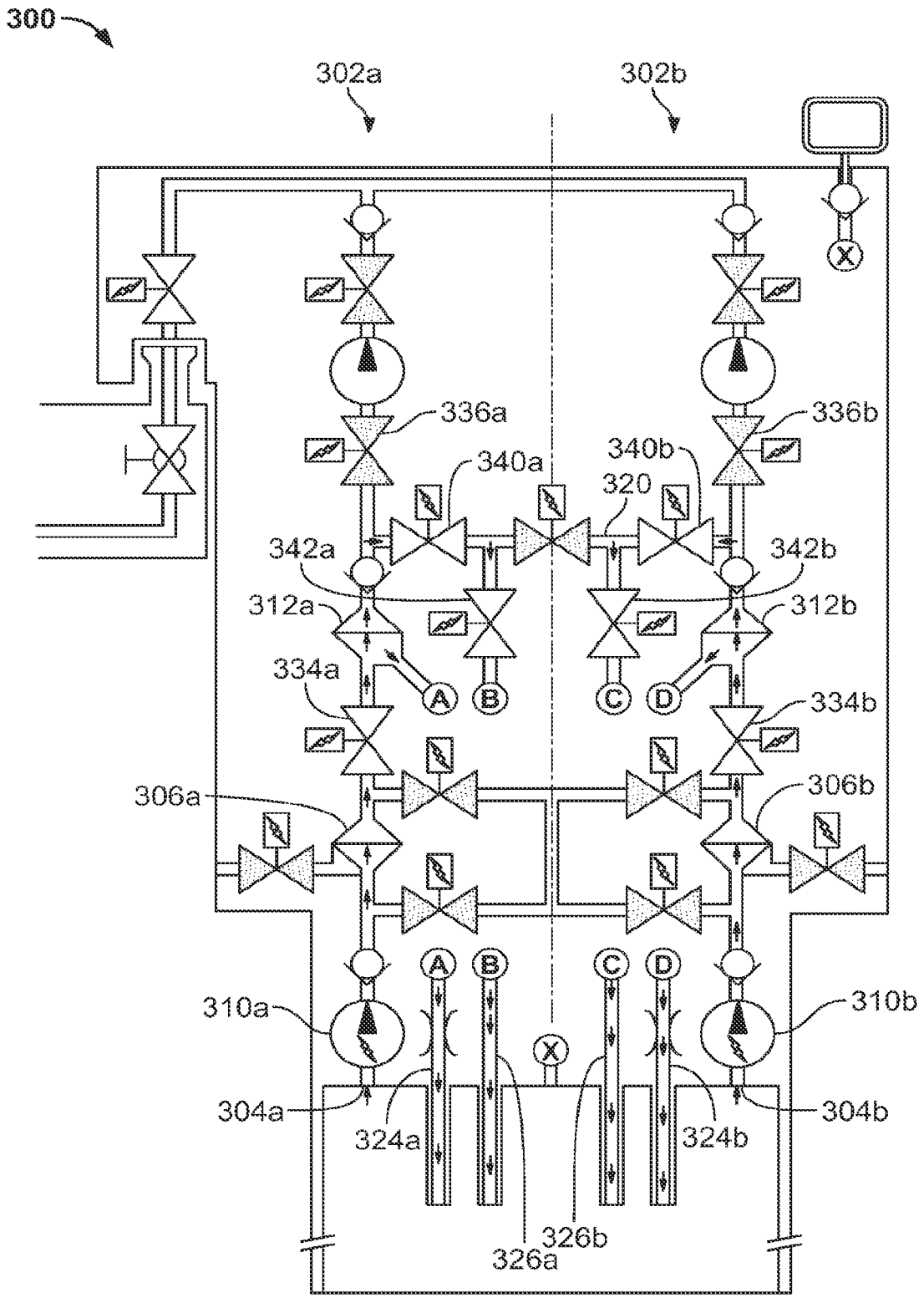
FIG. 3B is a schematic diagram showing a close-up view of the barrier fluid supply system of FIG. 3A showing an example operational mode.

FIG. 3B is a schematic diagram showing a close-up view of the barrier fluid supply system 300 of FIG. 3A showing an example operational mode. FIG. 3B corresponds to the operational scenario #4 shown in the Appendix. In FIG. 3B, both low pressure pumps 310*a* and 310*b* are active (shown by the lightning bolt on the pump icon). Therefore, fluid is flowing in both the first fluid circuit 302*a* and the second fluid circuit 302*b*. Taking the first fluid circuit 302*a* first: pump 310*a* moves water from the settling chamber 356 into the inlet 304*a*. The pump 310*a* moves the water through the filter 306*a* and to the membrane 312*a*, with valve 334*a* open. Some of the water passes through the membrane 312*a*. Because valve 336*a* is closed and valve 340*a* is open, the water is directed through valves 340*a* and 342*a*, through the return passage 326*a*. Some of the water is also directed to the reject passage 324*a* due to the nature of the membrane.

In this example, the fluid in the second fluid circuit 302*b* follows the corresponding path as the fluid in the first fluid circuit 302*a*. However, it is understood that the first fluid circuit 302*a* could operate as described above independent of whether the second fluid circuit 302*b* is operating, and vice versa.

Figure 3C:
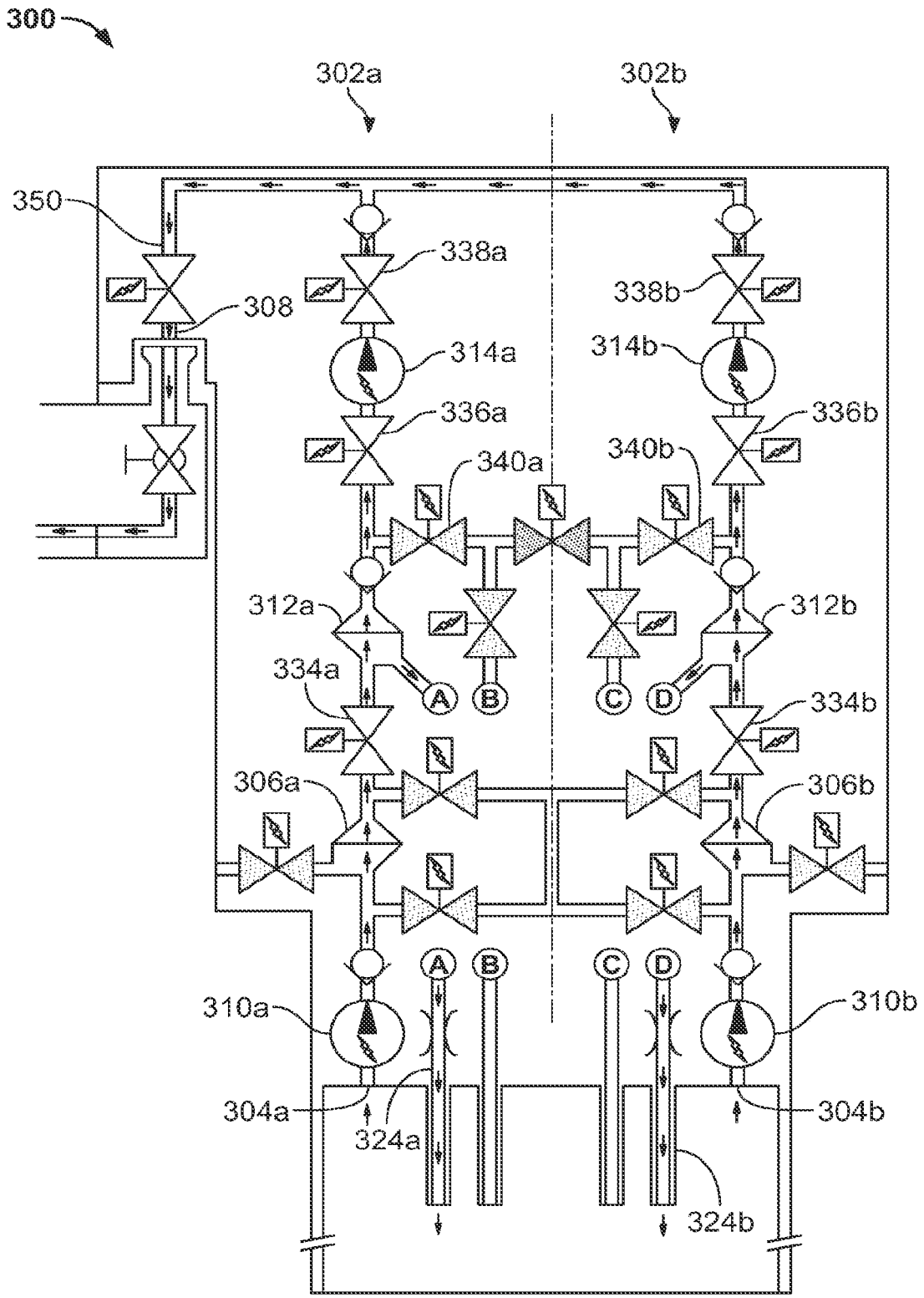
FIG. 3C is a schematic diagram showing a close-up view of the barrier fluid supply system of FIG. 3A showing an example operational mode.

FIG. 3C is a schematic diagram showing a close-up view of the barrier fluid supply system 300 of FIG. 3A showing another example operational mode. FIG. 3C corresponds to operational scenario #5 in the Appendix. In general, the operation shown in FIG. 3C is similar to that of FIG. 3B, except that valves 340*a* and 340*b* are closed, and valves 336*a,b* and 338*a,b* are open. With high pressure pumps 314*a,b* active, the water is moved from the inlet 304*a,b* to the outlet 308

Figure 3D:
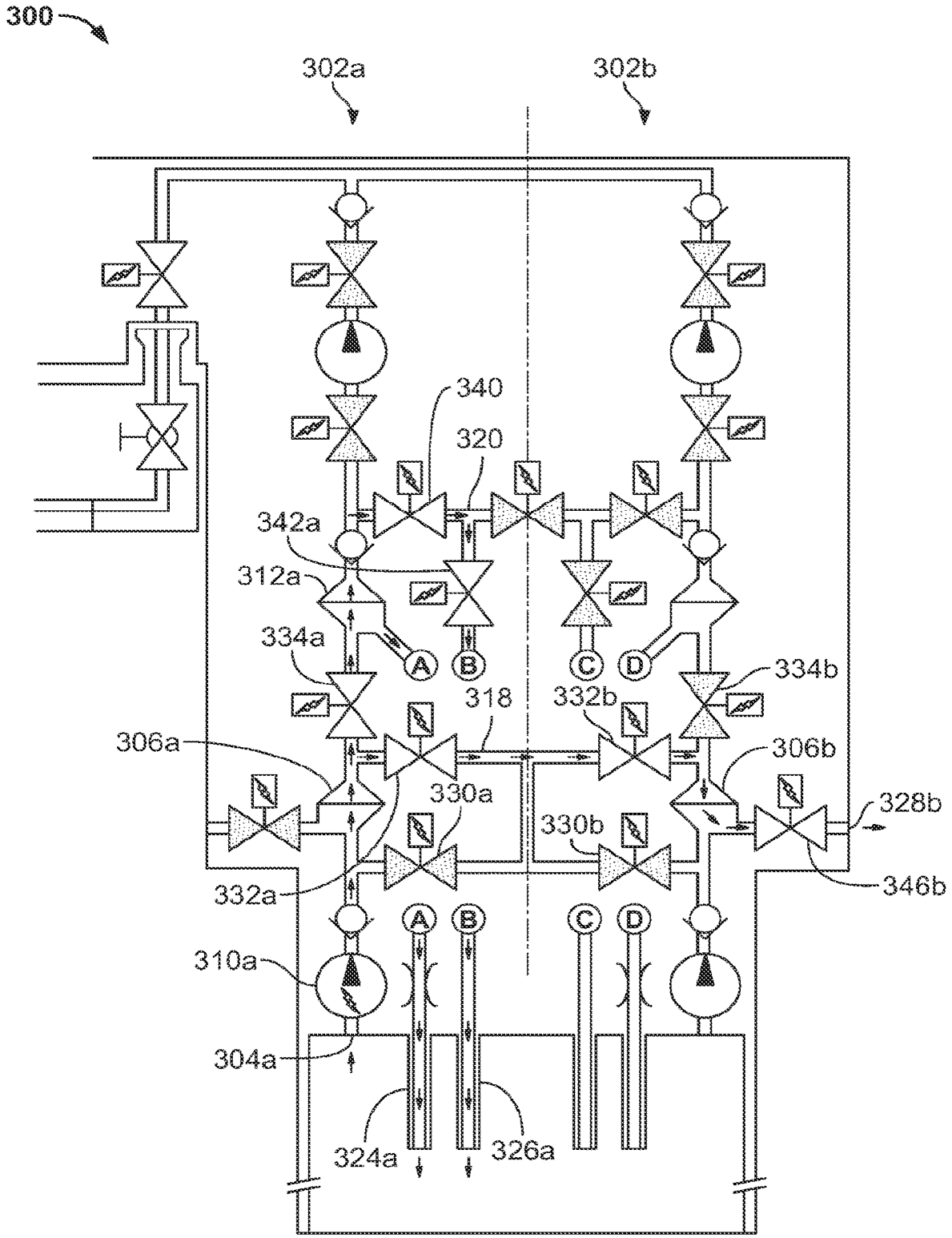
FIG. 3D is a schematic diagram showing a close-up view of the barrier fluid supply system of FIG. 3A showing an example operational mode.

FIG. 3D is a schematic diagram showing a close-up view of the barrier fluid supply system 300 of FIG. 3A showing yet another example operational mode. FIG. 3D corresponds to scenario #13 of the Appendix, showing a flush of the second filter 306*b*. The pump 310*a* is active and moves water through the first circuit, through the first mentioned filter 306*a* and the membrane 312*a*. The reject passage 324*a* allows excess flow upstream of the membrane 312*a* to exit the first fluid circuit 302*a*. Additionally, valves 332*a* and 332*b* are open and valve 330*a* is closed, and the fluid is directed to flow through the crossover path 318 from the first fluid circuit 302*a* to the second fluid circuit 302*b*. With valves 334*b* and 330*b* closed, the fluid is forced to backwash the second filter 306*b*. The backwash cleans the second filter 306*b*. The fluid is then directed through a reject passage 328*b* (with valve 346*b* open). A similar operation could be performed to clean filter 306*a*.

Figure 3E:
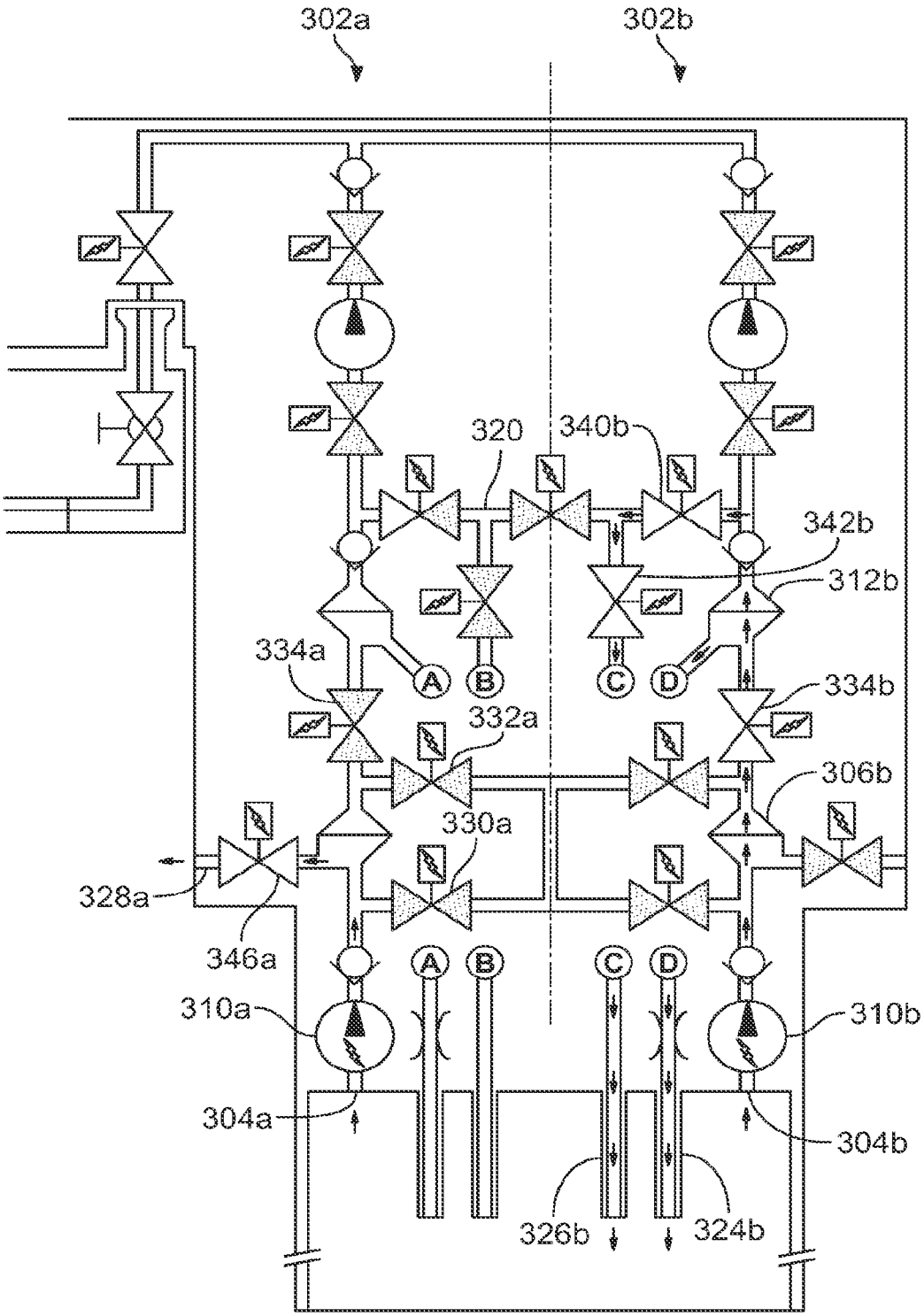
FIG. 3E is a schematic diagram showing a close-up view of the barrier fluid supply system of FIG. 3A showing an example operational mode.

FIG. 3E is a schematic diagram showing a close-up view of the barrier fluid supply system 300 of FIG. 3A showing yet another example operational mode. FIG. 3E corresponds to scenario #14 of the Appendix. In FIG. 3E, fluid flows through the second fluid circuit 302*b* as described in FIG. 3B. Fluid in the first fluid circuit 302*a*, however, is pumped immediately to a reject passage 328*a*. In some circumstances, water near the top of the solids settling chamber 356 may be very pure. Pure water may be corrosive to various components of the barrier fluid supply system 300 or other aspects of the submersible well fluid system 100. The reject passage 328*a* can be used to remove very pure water from the solids settling chamber 356 by directing back into the surrounding body of water, and reintroduce less pure water into the solids settling chamber 356. In FIG. 3E, pump 310*a* is active to move water into the fluid inlet 304*a*. Valves 330*a*, 332*a*, and 334*a* are closed, while valve 346*a* is open. The water is thus directed through the reject valve 328, outputting the water into the surrounding body of water.

Figure 3F:
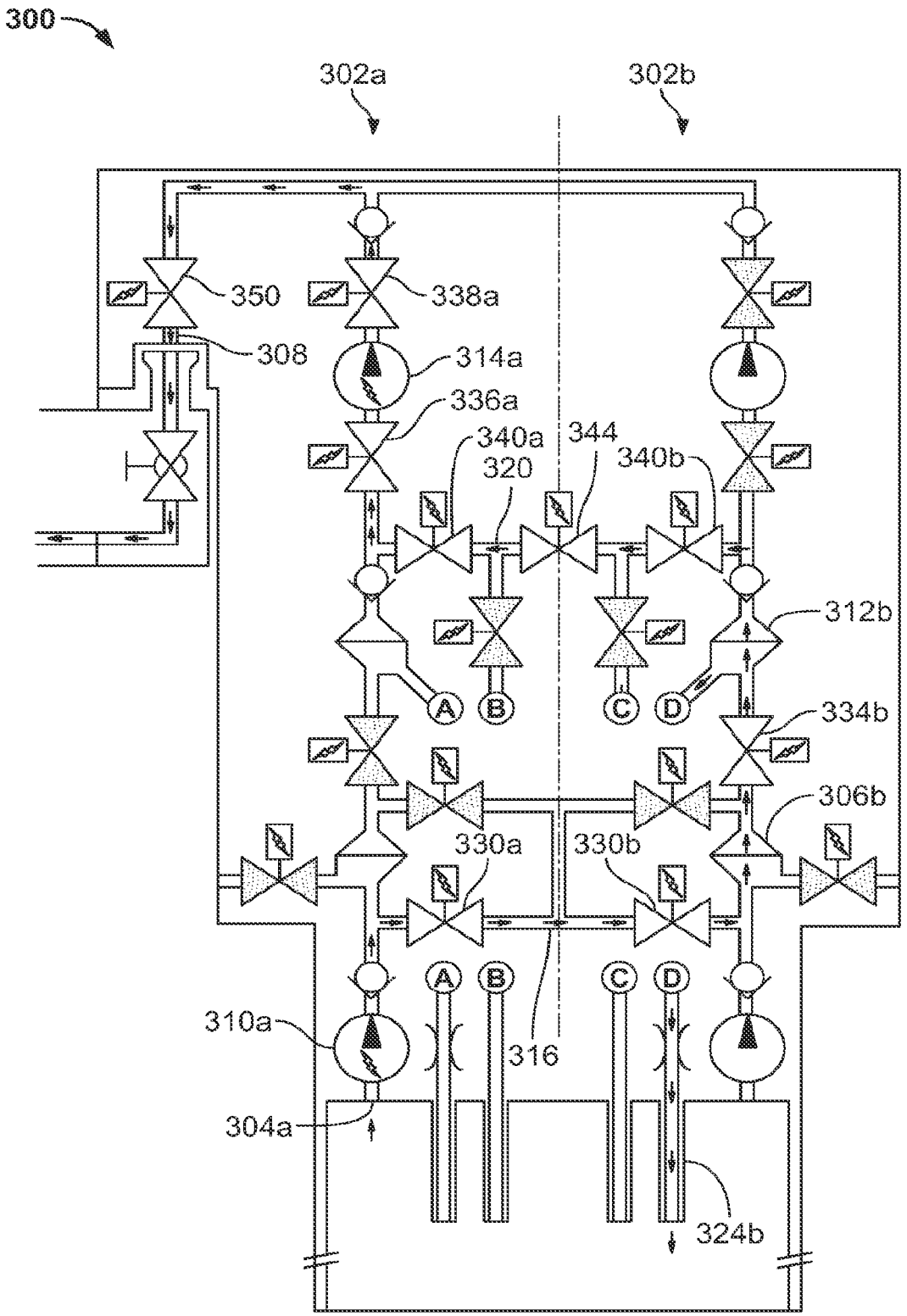
FIG. 3F is a schematic diagram showing a close-up view of the barrier fluid supply system of FIG. 3A showing an example operational mode.

FIG. 3F is a schematic diagram showing a close-up view of the barrier fluid supply system 300 of FIG. 3A showing yet another example operational mode. FIG. 3F corresponds to operational scenario #24 of the Appendix. In some implementations, one or both of the first mentioned filter 306*a* and the membrane 312*a* of the first fluid circuit 302*a* may be unavailable (e.g., they may be too dirty to use or may be broken). Or, pumps 310*b* or 314*b* of the second fluid circuit 302*b* may be unavailable. The pumps 310*a* and 314*a* of the first fluid circuit 302*a* can be used with the second filter 306*b* and/or the membrane 312*b* of the second fluid circuit 302*b*. With pump 310*a* active, water is moved into the inlet 304*a*. The water is directed through the crossover passage 316 that fluidically couples the first fluid circuit 302*a* with the second fluid circuit 302*b*. The water is moved through the second filter 306*b* and across the membrane 312*b*. Some of the water can be rejected and redirected back to the solids settling chamber 356 via the reject passage 324*b*. The water that passes through the membrane 312*b* can be directed through the crossover passage 320 with valves 340*a,b* and 344 open that fluidically couples the first fluid circuit 302*a* and the second fluid circuit 302*b* downstream of the membrane 312*a,b*. The high pressure pump 314*a* of the first fluid circuit 302*a* can then pump the water to the fluid outlet 308 (with valves 338*a* and 350 open). The same operational functionality could be achieved if the second filter 306*b* and membrane 312*b* of the second fluid circuit 302*b* were unavailable and/or the pumps of the first fluid circuit 302*a* were unavailable by reversing the roles of the fluid circuits.

Figure 3G:
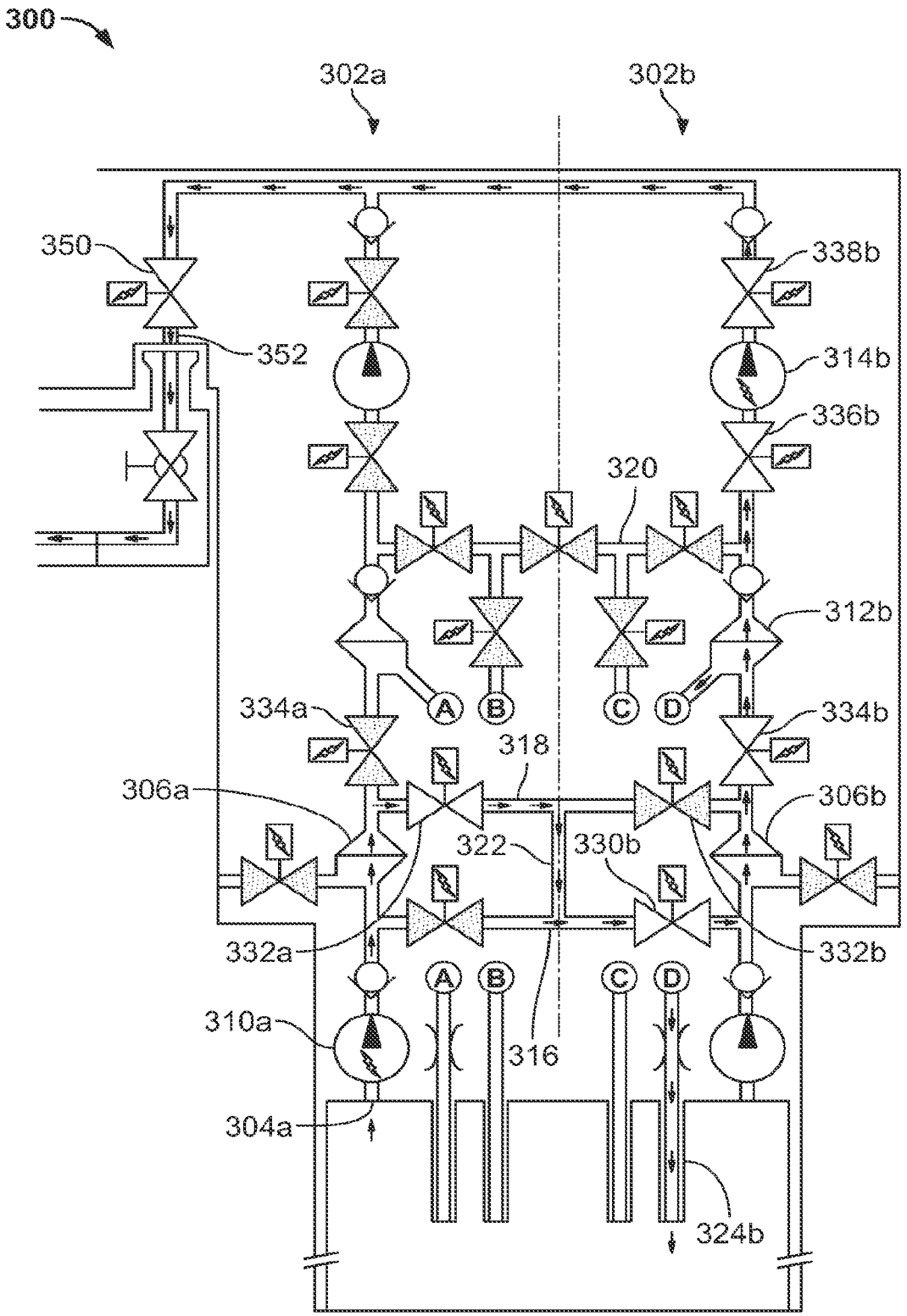
FIG. 3G is a schematic diagram showing a close-up view of the barrier fluid supply system of FIG. 3A showing an example operational mode.

FIG. 3G is a schematic diagram showing a close-up view of the barrier fluid supply system 300 of FIG. 3A showing yet another example operational mode. FIG. 3G corresponds to operational scenario #20 of the appendix. In some circumstances, the water in the solids settling chamber 356 may be especially dirty, and may benefit from multiple passes through a coarse filter. The operational scenario shown in FIG. 3G allows the water to undergo coarse filtering twice before being directed to the membrane. In the example shown in FIG. 3G water is pumped into the first fluid circuit 302*a* by pump 310*a* into inlet 304*a*. The water is pumped through the first mentioned filter 306*a*. With valve 334*a* closed and valve 332*a* open, the water is directed through the crossover passage 318. With valve 332*b* closed and valve 330 open, the water is redirected through a redirect valve 322 to crossover passage 316 and into the second fluid circuit 302*b*. The water is then pumped (with pump 310*a*) through the second filter 306*b*. The water can then be directed to the outlet 308 through either the second fluid circuit 302*b* (as shown) or through the first circuit using crossover passage 320.

Table 1 found in Appendix accompanying this disclosure provides example operational scenarios associated with the barrier fluid supply system of FIG. 3A, some of which are described above.

Figure 4:
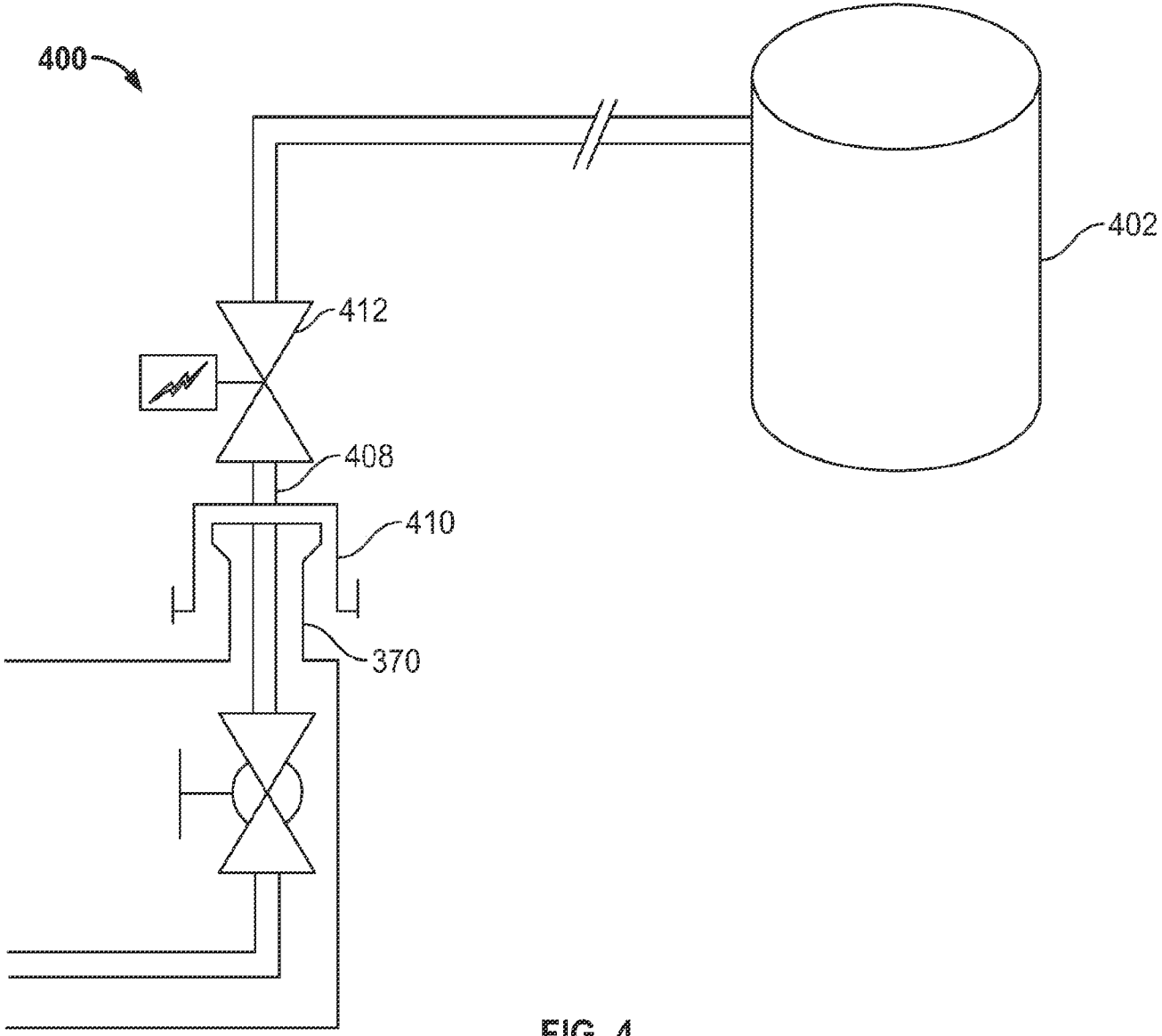
FIG. 4 is a schematic diagram showing a close-up view of an example barrier fluid with a barrier fluid supply tank.

In some implementations, the barrier fluid supply system 400 can include a submerged barrier fluid supply tank. FIG. 4 is a schematic diagram of a barrier fluid supply system 400 that includes a submerged barrier fluid supply tank 402. The submerged barrier fluid supply tank 402 is fluidically coupled to the submersible well fluid system 100 and is submerged in a body of water. The embodiment shown in FIG. 4 includes a barrier fluid inlet, a filter, which could be a multistage filter, and a barrier fluid outlet. Barrier fluid outlet is fluidically coupled to a barrier fluid inlet 370 of the submersible well fluid system 100, in this case, by the flange 410. Electronic valve 412 can open the fluid passage between the submerged barrier fluid supply tank 402 and the fluid inlet 370. A pump can pump the barrier fluid to the filter and to the barrier fluid outlet 408. The barrier fluid contained in the submerged barrier fluid supply tank 402 can include barrier fluids known to those of ordinary skill, such as mineral oil or a water+glycol mixture.

Returning to FIGS. 1C, 1D, and 3A, certain implementations of the submersible well fluid system 100 may include a pressure management system 160 to ensure that rotating seals 256 experience a barrier fluid system pressure greater than the process pressure at the inlet to fluid end 104. Under those conditions, barrier fluid will leak across the rotating seals 256 toward the process fluid and in so doing prevent process fluid, and any entrained solids, etc., from contacting the fluid film bearings and other sensitive fluid end features that are bathed with the barrier fluid.

Pressure management system 160 comprises a bellows 161 and a spring 162 to urge the bellows 161 toward a preferred state, either expanded or compressed depending on overall system design objectives and various considerations, e.g. sensitivity to ingress of debris. For applications such as that described herein, bellows 161 is typically a convoluted thin-metal construction that cannot tolerate significant differential pressure. Bellows 161 is positioned to be acted upon by process pressure on one side and by the barrier fluid on the other side, and bellows 161 will expand or contract in response to any difference in pressure acting on the inside and outside thereof. Adding spring 162 to one or the other side provides bellows 161 with a mechanism to resist the expansion or contraction that would otherwise result from even very small differences in pressure acting across bellows 161. The spring force divided by the plan area of bellows 161 defines a pressure differential that can be maintained being the fluids on the two sides of bellows 161.

FIG. 1C shows spring 162 positioned on the process side and urging the bellows 161 toward an expanded state, however, the arrangement might also be reversed—with the spring 162 urging the bellows 161 to compress. Regardless, the purpose of the spring 162 is to provide a mechanism to move the bellows 161 in a direction that attempts to squeeze the barrier fluid, resulting in a barrier fluid pressure somewhat greater than process pressure. As shown in FIG. 1A, the source of process pressure acting on bellows 161 is conduit 164 originating upstream of fluid end 104 at buffer tank 110. By virtue of its source location, conduit 164 will tend to be filled with gas, unless other arrangements are made. An advantage of sourcing process pressure influence from the top of buffer tank 110 is that solids carried by the process fluid is likely to be entrained in the denser, more viscous, liquid phase that moves rapidly to the bottom of buffer tank 110. Because it is desired to exclude solids from entering conduit 164 where they might make their way further to bellows 161 with potentially undesirable consequences, a solids exclusion device 170 may be integrated within buffer tank 110.

Rather than allow gas to fill conduit 164 where it might condense water that might foster growth of bacteria and/or formation of hydrates under various conditions, it is preferable to fill conduit 164 with e.g. chemicals. That may be achieved by introducing chemicals via chemical distribution manifold 142 and appropriate valves and conduits (reference FIG. 1D).

As noted previously, because spring 162 acting on bellows 161 creates a pressure on the barrier fluid that is greater than process pressure upstream of fluid end 104, and such greater pressure causes leakage across seals 256, there is a need on occasion to refill pressure management system 160 with barrier fluid. Sensors monitoring the position of a reference surface on bellows 161 will send a signal to the control system enabling it to determine when to refill pressure management system 160. In the case of the water filtration system barrier fluid system, appropriate valves will be commanded to open and one or more high pressure pumps will be activated to deliver water purified using filters and/or RO membranes into pressure management system 160.

Barrier fluid inside pressure management system 160 is circulated to and from fluid end 104, and within cavities of fluid end 104, via the various conduits 149, 150, 165, 166, 167, 168, 169, and also through heat exchanger 148 via conduits 147 and 150.

Figure 5A:
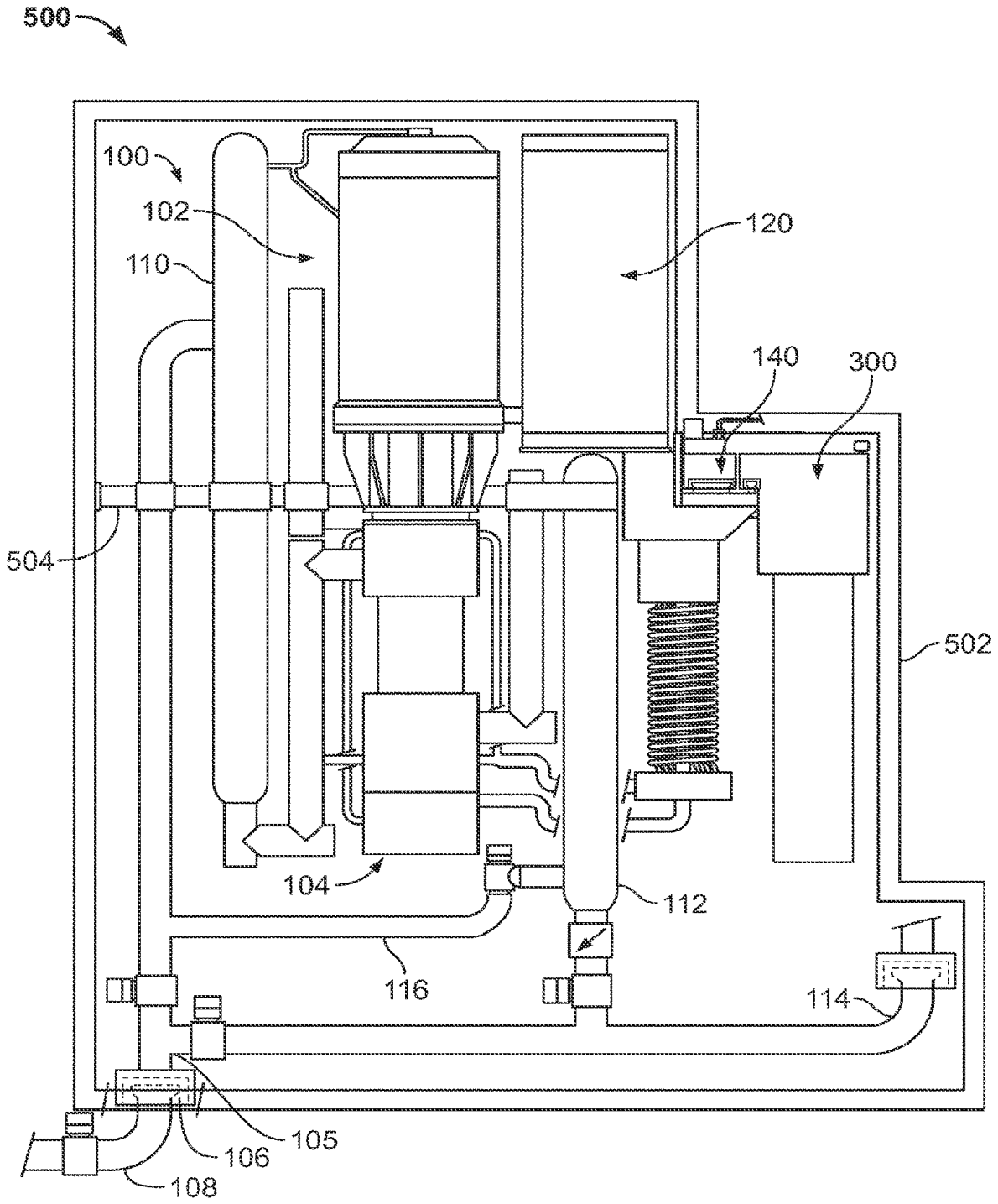
FIG. 5A is a schematic illustration of an example embodiment the submersible well fluid system carried by a frame.

FIG. 5A is a schematic illustration of an example embodiment 500 the submersible well fluid system 100 carried by a frame 502. The submersible well fluid system for operating submerged in a body of water may include a frame 502 adapted to couple to a wellhead assembly. An electric machine 102 that includes a rotor and a stator and a fluid end 104 that includes an impeller and coupled to the electric machine 102 may be carried by the frame 502. An adjustable speed drive 120 for the electric machine 102 carried on the frame 502. The term "carried" is meant to include supported, attached by across intermediate structures, etc. The frame 502 may be configured to frame the submersible well fluid system 100 (or some or all of its constituent components) off of the floor of the body of water. In some implementations, the frame 502 is adapted to couple to a wellhead assembly or an associated assembly to support the submersible well fluid system off the floor of the body of water. The process fluid inlet connector 106 is adapted to connect with the fluid outlet 108 to support the submersible well fluid system off of the floor of the body of water.

In some implementations, the submersible well fluid system includes a frame 502. The frame can carry one or more of the electric machine 102, the fluid end 104, and/or the adjustable speed drive 120. The frame 502 may surround the electric machine 102, fluid end 104, and adjustable speed drive 120. In some implementations, the frame 502 may carry the chemical distribution system 140 either alone or in combination with one or more of the electric machine 102, the fluid end 104, and/or the adjustable speed drive 120. In some implementations, the submersible well fluid system includes a frame 502 the barrier fluid supply system 300 with one or more of the electric machine 102, the fluid end 104, and/or the adjustable speed drive 120.

As mentioned above, the submersible well fluid system may include a buffer tank 110 in the fluid path 107 from the process fluid inlet 105. The buffer tank 110 is carried by the frame 502, e.g., by a support member 504. The submersible well fluid system 100 may include a gas/liquid separator 112 in the fluid path and adapted to output to the process fluid outlet 114. The gas/liquid separator can be carried by the frame 502, e.g., by frame member 504. The submersible well fluid system 100 may include a recirculation fluid path 116 coupled to the gas/liquid separator 112 and to the fluid path from the process fluid inlet 105 to the fluid end 104. The recirculation fluid path 116 can be carried by the frame 502.

Figure 5B:
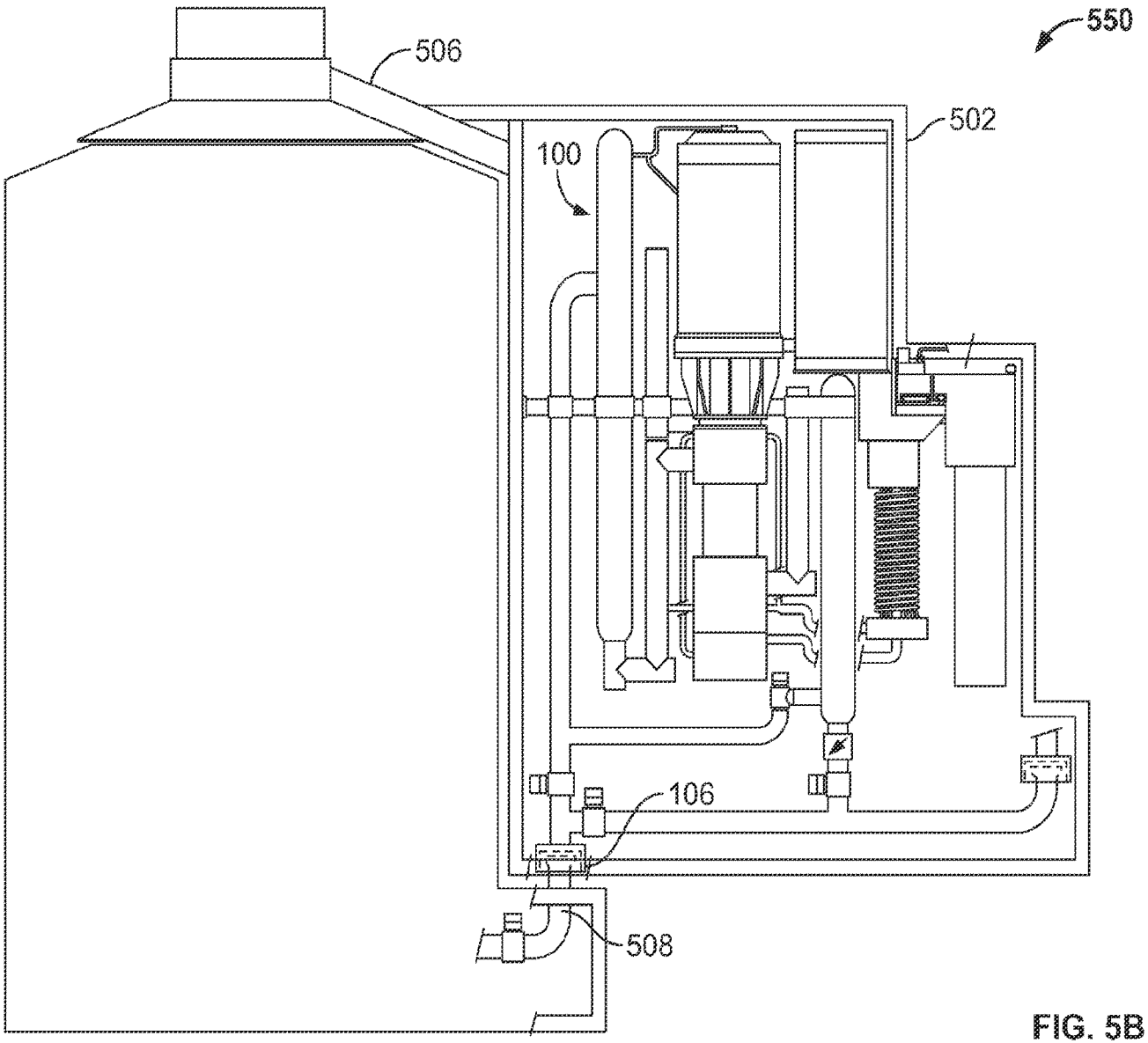
FIG. 5B is a schematic illustration of an example embodiment the submersible well fluid system carried by a frame that is coupled to a host assembly

FIG. 5B is a schematic illustration of an example embodiment 550 the submersible well fluid system 100 carried by a frame 502 that is coupled to a host assembly 506. Host assembly 506 can be a wellhead assembly, such as a Christmas Tree assembly, or an assembly associated with and downstream from the wellhead assembly, such as a manifold, pump-base, boosting station, sled for flow lines, riser base, etc. In some implementations, the frame 502 may be adapted to couple to a wellhead assembly or an associated assembly to support the submersible well fluid system. The frame 502 may be adapted to support the submersible well fluid system 100 off the floor of the body of water. The submersible well fluid system 100 may include a process fluid inlet connector 106 in fluid communication with the fluid end 104 and adapted to connect to a fluid outlet 508 associated with a wellhead assembly or a wellhead associated assembly. The process fluid inlet connector 106 may be adapted to connect with the fluid outlet 508 to support the submersible well fluid system 100. For example, the process fluid inlet connector 106 is adapted to connect with the fluid outlet 508 to support the submersible well fluid system 100 off of the floor of the body of water. Fluid outlet 508 may be the same or similar to fluid outlet 108.

Aspect 1. A submersible well fluid system for operating submerged in a body of water, including:

an electric machine comprising a rotor and a stator residing in a first housing at specified conditions;

a fluid end comprising an impeller and coupled to the electric machine; and an adjustable speed drive for the electric machine in a second housing.

Aspect 2. The submersible well fluid system of aspect 1, where the second housing is in fluid communication with the first housing.

Aspect 3. The submersible well fluid system of aspect 2, including a conduit between the first and second housings providing fluid communication between the first and second housings.

Aspect 4. The submersible well fluid system of aspect 2, where the fluid at specified conditions includes substantially gas.

Aspect 5. The submersible well fluid system of aspect 2, where the fluid at specified conditions is substantially at atmospheric pressure.

Aspect 6. The submersible well fluid system of aspect 2, where the fluid at specified conditions includes substantially liquid.

Aspect 7. The submersible well fluid system of aspect 2, where the submersible well fluid system is for operating at a specified depth in a body of water, and where the fluid at specified conditions is at ambient pressure when the submersible well fluid system is submerged to the specified depth in the body of water.

Aspect 8. The submersible well fluid system of aspect 1, where the first housing is affixed to the second housing.

Aspect 9. The submersible well fluid system of aspect 1, where the first housing and the second housing are a single integrated housing.

Aspect 10. The submersible well fluid system of aspect 1, comprising a frame carrying the electric machine, the fluid end, and the adjustable speed drive.

Aspect 11. The submersible well fluid system of aspect 10, where the frame surrounds the electric machine, fluid end, and adjustable speed drive.

Aspect 12. The submersible well fluid system of aspect 10, where the frame is adapted to couple to a wellhead assembly or an associated assembly to support the submersible well fluid system.

Aspect 13. The submersible well fluid system of aspect 12, where the frame is adapted to support the submersible well fluid system off the floor of the body of water.

Aspect 14. The submersible well fluid system of aspect 12, including a process fluid inlet connector in fluid communication with the fluid end and adapted to connect to a fluid outlet associated with the wellhead assembly.

Aspect 15. The submersible well fluid system of aspect 14, where the process fluid inlet connector is adapted to connect with the fluid outlet to support the submersible well fluid system.

Aspect 16. The submersible well fluid system of aspect 15, where the process fluid inlet connector is adapted to connect with the fluid outlet to support the submersible well fluid system off of the floor of the body of water.

Aspect 17. The submersible well fluid system of aspect 1, including a process fluid inlet connector in fluid communication with the fluid end and adapted to connect to a fluid outlet associated with a wellhead assembly.

Aspect 18. The submersible well fluid system of aspect 17, where the process fluid inlet connector is adapted to connect with the fluid outlet to support the submersible well fluid system off the floor of the body of water.

Aspect 19. The submersible well fluid system of aspect 10, including:

a process fluid inlet coupled to a fluid path to the impeller; and a buffer tank in the fluid path and adapted to mix uncombined gas and liquid process fluid and to supply the mixed gas and liquid to the impeller; and where the buffer tank is carried by the frame.

Aspect 20. The submersible well fluid system of aspect 19, including:

a process fluid outlet coupled to a fluid path from the impeller; and a gas/liquid separator in the fluid path and adapted to output to the process fluid outlet; and where the gas/liquid separator is carried by the frame.

Aspect 21. The submersible well fluid system of aspect 20, including a recirculation fluid path coupled to the gas/liquid separator and to the fluid path from the process fluid inlet to the f, the recirculation fluid path carried by the frame; and where the gas/liquid separator is adapted to output preferentially liquid to the recirculation fluid path.

Aspect 22. The submersible well fluid system of aspect 21, where one or both of the buffer tank and gas/liquid separator are affixed to the first housing.

Aspect 23. The submersible well fluid system of aspect 1, including:

a process fluid inlet to the submersible well fluid system; and a bypass fluid path adapted to allow process fluid to flow from a location proximate the process fluid inlet around the fluid end.

Aspect 24. The submersible well fluid system of aspect 23, including:

a process fluid outlet from the submersible well fluid system; and where the bypass fluid path is a tube between the process fluid inlet and the process fluid outlet.

Aspect 25. The submersible well fluid system of aspect 1, where the electric machine includes a synchronous permanent magnet machine.

Aspect 26. The submersible well fluid system of aspect 1, where the adjustable speed drive includes active power factor correcting front end.

Aspect 27. The submersible well fluid system of aspect 25, where the active power factor correcting front end includes:

an input power line filter; and an active power factor correcting rectifier configured to switch at a frequency greater than 60 Hertz.

Aspect 28. The submersible well fluid system of aspect 25, where the adjustable speed drive is provided without an input transformer.

Aspect 29. The submersible well fluid system of aspect 25, where the active power factor correcting front end comprises an inverter configured to receive alternating current and output direct current.

Aspect 30. The submersible well fluid system of aspect 1, where the adjustable speed drive is cooled only by passive cooling.

Aspect 31. The submersible well fluid system of aspect 29, where the adjustable speed drive is adapted to transfer the heat generated during operation substantially by conduction through the housing assembly to the body of water.

Aspect 32. The submersible well fluid system of aspect 29, where the adjustable speed drive includes electrical components in contact with the interior of the housing assembly.

Aspect 33. The submersible well fluid system of aspect 1, where the submersible well fluid system is adapted to operate submerged at a specified depth in the body of water; and the adjustable speed drive includes an internal structure that carries electrical components within a drive housing and is adapted to provide necessary support to the drive housing against collapse at the specified depth.

Aspect 34. The submersible well fluid system of aspect 8, including a power conductor in the conduit, the power conductor electrically coupled to the electric machine and the adjustable speed drive.

Aspect 35. The submersible well fluid system of aspect 8, including a control communication line in the conduit.

Aspect 36. The submersible well fluid system of aspect 1, including:

a process fluid outlet adapted to output process fluid from the submersible well fluid system; and a chemical distribution system adapted to couple to a treatment chemical storage tank and provide a treatment chemical from the tank to the process fluid upstream of the process fluid outlet.

Aspect 37. The submersible well fluid system of aspect 36, where the chemical distribution system includes a manifold adapted to direct the treatment chemical received from the chemical storage tank to one or more locations upstream of the process fluid outlet.

Aspect 38. The submersible well fluid system of aspect 36, including a frame carrying the electric machine, the fluid end, and the chemical distribution system.

Aspect 39. The submersible well fluid system of aspect 38, where the frame is adapted to couple to a wellhead assembly or an associated assembly to support the submersible well fluid system off the floor of the body of water.

Aspect 40. The submersible well fluid system of aspect 36, where the chemical storage tank is submerged in the body of water.

Aspect 41. The submersible well fluid system of aspect 36, where the treatment chemicals include one or more of a hydrate inhibitor, a wax inhibitor, a scale inhibitor, a foam inhibitor, or a corrosion inhibitor.

Aspect 42. The submersible well fluid system of aspect 36, including a barrier fluid supply system adapted to supply a barrier fluid to the fluid end.

Aspect 43. The submersible well fluid system of aspect 1, including a barrier fluid supply system adapted to supply a barrier fluid to the fluid end.

Aspect 44. The submersible well fluid system of aspect 43, where the fluid end includes a fluid film bearing and where the barrier fluid supply system is adapted to supply a barrier fluid to the fluid film bearing.

Aspect 45. The submersible well fluid system of aspect 43, including a submerged barrier fluid supply tank.

Aspect 46. The submersible well fluid system of aspect 43, where the barrier fluid supply system includes:

a water treatment system comprising a water inlet adapted to intake water from the body of water; and a filter coupled to the inlet and adapted to filter the collected water.

Aspect 47. The submersible well fluid system of aspect 43, including a frame carrying the electric machine, the fluid end and the barrier fluid supply system.

Aspect 48. The submersible well fluid system of aspect 47, where the frame is adapted to couple to a wellhead assembly or an associated assembly to support the submersible well fluid system off the floor of the body of water.

Aspect 49. The submersible well fluid system of aspect 43, where the barrier fluid supply system is integrated with the submersible well fluid system.

Aspect 50. A submersible well fluid system for operating submerged in a body of water, including:

a frame adapted to couple to a wellhead assembly;

an electric machine comprising a rotor and a stator;

a fluid end comprising an impeller and coupled to the electric machine; and an adjustable speed drive for the electric machine carried on the frame.

Aspect 51. The submersible well fluid system of aspect 50, where the electric machine and fluid end are carried on the frame.

Aspect 52. The submersible well fluid system of aspect 50, where the frame is adapted to support the adjustable speed drive off the floor of the body of water.

Aspect 53. The submersible well fluid system of aspect 50, including a first housing containing the electric machine and a second housing affixed to the first housing and containing the adjustable speed drive.

Aspect 54. The submersible well fluid system of aspect 50, including a process fluid inlet connector in fluid communication with the fluid end and adapted to connect to a fluid outlet associated with the wellhead assembly.

Aspect 55. The submersible well fluid system of aspect 54, where the process fluid inlet connector is adapted to connect with the fluid outlet to support the submersible well fluid system.

Aspect 56. The submersible well fluid system of aspect 55, where the process fluid inlet connector is adapted to connect with the fluid outlet to support the submersible well fluid system off the floor of the body of water.

Aspect 57. The submersible well fluid system of aspect 50, where the frame surrounds the adjustable speed drive.

Aspect 58. The submersible well fluid system of aspect 51, where the frame surrounds the electric machine, fluid end and adjustable speed drive.

Aspect 59. The submersible well fluid system of aspect 50, including a housing and where the electric machine resides in the housing; and where the adjustable speed drive is affixed to the housing.

Aspect 60. The submersible well fluid system of aspect 50, including:

a process fluid inlet coupled to a fluid path to the fluid end; and a buffer tank in the fluid path and adapted to mix uncombined gas and liquid process fluid and to supply the mixed gas and liquid to the impeller; and where the buffer tank is carried by the frame.

Aspect 61. The submersible well fluid system of aspect 60, including:

a process fluid outlet coupled to a fluid path from the fluid end; and a gas/liquid separator in the fluid path and adapted to output to the process fluid outlet; and where the gas/liquid separator is carried by the frame.

Aspect 62. The submersible well fluid system of aspect 61, including a housing containing the electric machine and where one or both of the buffer tank and gas/liquid separator are affixed to the housing.

Aspect 63. The submersible well fluid system of aspect 61, including a recirculation fluid path coupled to the gas/liquid separator and to the fluid path from the process fluid inlet to the fluid end, the recirculation fluid path carried by the frame; and where the gas/liquid separator is adapted to output preferentially liquid to the recirculation fluid path.

Aspect 64. The submersible well fluid system of aspect 63, including a bypass fluid path coupled to the process fluid inlet and the process fluid outlet to bypass the fluid end.

Aspect 65. The submersible well fluid system of aspect 64, where the bypass fluid path is a tube carried by the frame.

Aspect 66. The submersible well fluid system of aspect 50, where the electric machine includes a synchronous permanent magnet machine.

Aspect 67. The submersible well fluid system of aspect 50, where the adjustable speed drive includes an active power factor correcting front end.

Aspect 68. The submersible well fluid system of aspect 66, where the active power factor correcting front end includes an inverter configured to receive alternating current and output direct current.

Aspect 69. The submersible well fluid system of aspect 66, where the active power factor correcting front end includes:

an input power line filter; and an active power factor correcting rectifier configured to switch at a frequency greater than 60 Hertz.

Aspect 70. The submersible well fluid system of aspect 67, where the adjustable speed drive is provided without an input transformer electrically coupled to a rectifier of the adjustable speed drive.

Aspect 71. The submersible well fluid system of aspect 50, where the adjustable speed drive is cooled only by passive cooling.

Aspect 72. The submersible well fluid system of aspect 50, including:

a process fluid outlet adapted to output process fluid from the submersible well fluid system; and a chemical distribution system adapted to couple to a submerged treatment chemical storage tank and to provide a treatment chemical from the tank to the process fluid upstream of the process fluid outlet.

Aspect 73. The submersible well fluid system of aspect 72, where chemical distribution system is carried by the frame.

Aspect 74. The submersible well fluid system of aspect 73, including:

a first housing containing the electric machine; and wherein the chemical distribution system is integrated to the first housing.

Aspect 75. The submersible well fluid system of aspect 72, where the treatment chemicals include one or more of a hydrate inhibitor, a wax inhibitor, a scale inhibitor, a foam inhibitor, or a corrosion inhibitor.

Aspect 76. The submersible well fluid system of aspect 72, including a barrier fluid supply system adapted to supply a barrier fluid to the fluid end.

Aspect 77. The submersible well fluid system of aspect 50, including a barrier fluid supply system adapted to supply a barrier fluid to the fluid end.

Aspect 78. The submersible well fluid system of aspect 77, including a submerged barrier fluid supply tank.

Aspect 79. The submersible well fluid system of aspect 77, wherein the barrier fluid includes unfiltered water.

Aspect 80. The submersible well fluid system of aspect 77, where the barrier fluid supply system includes:

a water treatment system including a water inlet adapted to intake water from the body of water; and a filter coupled to the inlet and adapted to filter the collected water.

Aspect 81. The submersible well fluid system of aspect 77, where the barrier fluid supply system is carried by the frame.

Aspect 82. The submersible well fluid system of aspect 81, including:

a first housing containing the electric machine; and a second housing containing the barrier fluid supply system, the second housing affixed to the first housing.

Aspect 83. A submersible well fluid system for operating submerged in a body of water, including:

an electric machine including a rotor and a stator;

a fluid end including an impeller and coupled to the electric machine; and a barrier fluid supply system adapted to supply a barrier fluid from a submerged source to the fluid end.

Aspect 84. The submersible well fluid system of aspect 83, where the fluid end includes a fluid film bearing and where the barrier fluid supply system is adapted to supply a barrier fluid to the fluid film bearing.

Aspect 85. The submersible well fluid system of aspect 83, where the submerged source includes a barrier fluid supply tank.

Aspect 86. The submersible well fluid system of aspect 83, where the barrier fluid includes unfiltered water.

Aspect 87. The submersible well fluid system of aspect 83, where the submerged source includes water from the body of water and the barrier fluid supply system includes:

a water treatment system including a water inlet adapted to intake water from the body of water; and a filter coupled to the inlet and adapted to filter the collected water.

Aspect 88. The submersible well fluid system of aspect 83, including a frame carrying the electric machine, the fluid end, and the barrier fluid supply system.

Aspect 89. The submersible well fluid system of aspect 88, including:

a first housing containing the electric machine; and a second housing containing the barrier fluid supply system, the second housing coupled to the first housing the submersible well fluid system.

Aspect 90. The submersible well fluid system of aspect 88, where the frame is adapted to couple to a wellhead assembly or an associated assembly to support the submersible well fluid system off the floor of the body of water.

Aspect 91. The submersible well fluid system of aspect 83, including an adjustable speed drive for the electric machine.

Aspect 92. The submersible well fluid system of aspect 83, including:

a process fluid outlet adapted to output process fluid from the submersible well fluid system; and a chemical distribution system adapted to couple to a submerged treatment chemical storage tank and provide a treatment chemical from the tank to the process fluid upstream of the process fluid outlet.

Aspect 93. The submersible well fluid system of aspect 92, including a frame configured to carrying the electric machine, the fluid end, the barrier fluid supply system and the chemical distribution system.

Aspect 94. The submersible well fluid system of aspect 92, where the treatment chemicals include one or more of a hydrate inhibitor, a wax inhibitor, a scale inhibitor, a foam inhibitor, or a corrosion inhibitor.

Aspect 95. The submersible well fluid system of aspect 92, including an adjustable speed drive for the electric machine.

Aspect 96. The submersible well fluid system of aspect 95, including a frame configured to carrying the electric machine, the fluid end, the barrier fluid supply system and the chemical distribution system.

Aspect 97. A submersible well fluid system for operating submerged in a body of water, including:

an electric machine including a rotor and a stator;

a fluid end including an impeller and coupled to the electric machine;

a process fluid outlet adapted to output process fluid from the submersible well fluid system; and a chemical distribution system adapted to couple to a submerged treatment chemical storage tank and provide a treatment chemical to one or more locations of the submersible well fluid system.

Aspect 98. The submersible well fluid system of aspect 97, including a frame configured to carry the electric machine and the chemical distribution system.

Aspect 99. The submersible well fluid system of aspect 98 including:

a first housing containing the electric machine; and where the chemical distribution system is integrated with the first housing.

Aspect 100. The submersible well fluid system of aspect 97, where the treatment chemicals include one or more of a hydrate inhibitor, a wax inhibitor, a scale inhibitor, a foam inhibitor, or a corrosion inhibitor.

Aspect 101. The submersible well fluid system of aspect 97, where the chemical distribution system includes a manifold configured to receive a chemical from the submerged treatment chemical storage tank and distribute the chemical to the one or more locations of the submersible well fluid system.

Aspect 102. The submersible well fluid system of aspect 97, where the one or more locations of the submersible well fluid system includes the fluid end, a pressure management system, or at a location of the submersible well fluid system upstream of the process fluid outlet.

Aspect 103. A submersible barrier fluid supply system for a submersible well fluid system for operating submerged in a body of water, including:

an inlet adapted to intake a barrier fluid;

a filter in communication with the inlet adapted to filter the barrier fluid;

a barrier fluid outlet in communication with the filter adapted to couple to a barrier fluid inlet of the submersible fluid system and to supply the filtered barrier fluid to the barrier fluid inlet of the submersible fluid system.

Aspect 104. The submersible barrier fluid supply system of aspect 103, including a submerged barrier fluid supply tank coupled to the inlet and including a barrier fluid.

Aspect 105. The submersible barrier fluid supply system of aspect 103, where the inlet includes a water inlet adapted to intake water from the surrounding body of water.

Aspect 106. The submersible barrier fluid supply system of aspect 105, including a housing internally defining a solids settling chamber exterior to and around the water inlet, the housing including a water inlet adapted to intake water from the surrounding body of water into the solids settling chamber.

Aspect 107. The submersible barrier fluid supply system of aspect 106, where the housing is adapted to cause water in the solids settling chamber to be more substantially quiescent than the surrounding body of water.

Aspect 108. The submersible barrier fluid supply system of aspect 106, where the sidewalls of the housing are solid and unapertured.

Aspect 109. The submersible barrier fluid supply system of aspect 103, where the filter includes a multi-stage filter.

Aspect 110. The submersible barrier fluid supply system of aspect 109, where the multi-stage filter includes a reverse osmosis membrane filter downstream from a coarse filter.

Aspect 111. The submersible barrier fluid supply system of aspect 103, further including a pump configured to move fluid from the inlet to the barrier fluid outlet and across the filter.

Aspect 112. The submersible barrier fluid supply system of aspect 103, further including a membrane downstream of the filter, the membrane configured to further filter the barrier fluid.

Aspect 113. The submersible barrier fluid supply system of aspect 112, further including a pump downstream of the membrane and configured to move fluid that has passed through the membrane to the barrier fluid outlet.

Aspect 114. The submersible barrier fluid supply system of aspect 112, further including a reject passage fluidically coupled to an upstream side of the membrane and configured to direct fluid that has not passed through the membrane to a solids settling chamber.

Aspect 115. The submersible barrier fluid supply system of aspect 110, further including a return passage downstream of the membrane and configured to direct fluid that passes through the membrane to the body of water.

Aspect 116. The submersible barrier fluid supply system of aspect 103, including:

a first fluid circuit including the first mentioned filter;

a second fluid circuit, in fluidic parallel to the first fluid circuit, and including a second filter.

Aspect 117. The submersible barrier fluid supply system of aspect 116, including a crossover passage fluidically coupling the first fluid circuit and the second fluid circuit.

Aspect 118. The submersible barrier fluid supply system of aspect 117, further including membrane, where the crossover passage is located downstream of the membrane and configured to allow filtered fluid to flow from the first fluid circuit to the second fluid circuit.

Aspect 119. The submersible barrier fluid supply system of aspect 117, where the crossover passage is adapted to communicate fluid in the first fluid circuit to the second filter to be filtered by the second filter.

Aspect 120. The submersible barrier fluid supply system of aspect 117 including:

a first pump in the first fluid circuit; and where the crossover passage is adapted to communicate fluid in the first fluid circuit to the second fluid circuit.

Aspect 121. The submersible barrier fluid supply system of aspect 116, where the first fluid circuit includes a first pump and the second fluid circuit includes a second pump; and where the submersible barrier fluid supply system includes a first crossover passage fluidically coupling the first fluid circuit and the second fluid circuit downstream of the first and second pumps, between the pumps and the first mentioned filter and second filter.

Aspect 122. The submersible barrier fluid supply system of aspect 116, where the first fluid circuit includes a first pump and the second fluid circuit includes a second pump; and where the submersible barrier fluid supply system includes:

a first crossover passage fluidically coupling the first fluid circuit and the second fluid circuit downstream of the first and second pumps, between the pumps and the first mentioned filter and second filter;

a second crossover passage fluidically coupling the first fluid circuit and the second fluid circuit at a location downstream of the first mentioned filter and the second filter.

Aspect 123. The submersible barrier fluid supply system of aspect 116 including a clean-out circuit including:

a bypass crossover passage fluidically coupling the first fluid circuit and the second fluid circuit downstream of the first mentioned filter and the second filter, the bypass crossover passage configured to supply a back flush flow of fluid to the second filter; and a reject passage fluidically coupled to a passage between the inlet and the second filter to receive the back flush flow of fluid from the second filter.

Aspect 124. The submersible barrier fluid supply system of aspect 123, wherein the reject passage is configured to direct the back flush flow to the body of water.

Aspect 125. The submersible barrier fluid supply system of aspect 117, where the crossover passage is a first crossover passage fluidically coupling the first fluid circuit and the second fluid circuit upstream of the first mentioned filter and the second filter, the submersible barrier fluid supply system further including:

a second crossover passage fluidically coupling the first fluid circuit and the second fluid circuit downstream of the first mentioned filter and the second filter; and a redirect passage fluidically coupling the first crossover passage and the second crossover passage, the redirect passage configured to enable fluid to flow between the second crossover passage and the first crossover passage.

Aspect 126. The submersible barrier fluid supply system of aspect 116, where the first circuit includes a low pressure pump upstream of the first mentioned filter and a high pressure pump downstream of the first mentioned filter.

Aspect 127. The submersible barrier fluid supply system of aspect 116, where the second circuit includes a low pressure pump upstream of the second filter and a high pressure pump downstream of the second filter.

Aspect 128. The submersible barrier fluid supply system of aspect 103 further including a reject passage fluidically coupled to a passage between the inlet and the first mentioned filter to receive the back flush flow of fluid from the first mentioned filter.

Aspect 129. The submersible barrier fluid supply system of aspect 103, further including a reject passage fluidically coupled to a passage between the inlet and the first mentioned filter to receive fluid from the inlet and direct it to the body of water.

Aspect 130. The submersible barrier fluid supply system of aspect 103, where the submersible barrier fluid supply system is configured to supply barrier fluid to one or more seals of a fluid end of the submersible well fluid system.

Aspect 131. The submersible barrier fluid supply system of aspect 130, where the barrier fluid is maintained at a pressure higher than the process fluid at a process fluid inlet of the fluid end.

Aspect 132. The submersible barrier fluid supply system of aspect 103, including a clean-out circuit including:

a bypass fluidically coupling the first fluid circuit and the second fluid circuit downstream of the first mentioned filter and the second filter, the bypass crossover configured to supply a back flush flow of fluid to one or both of the first mentioned filter and the second filter; and a reject passage fluidically coupled to a passage between the inlet and the second filter to receive the back flush flow of fluid from the second filter.

Aspect 133. The submersible barrier fluid supply system of aspect 103, where the barrier fluid outlet is in fluid communication with a bellows chamber, the bellows chamber including a bellows, and where the submersible barrier fluid supply system is configured to supply barrier fluid to the bellows chamber upon expansion of the bellows.

Aspect 134. The submersible barrier fluid supply system of aspect 133, including a bias spring configured to bias the bellows to expand.

Aspect 135. A submersible barrier fluid supply system for a submersible fluid system for operating submerged in a body of water, including:

an inlet adapted to intake a barrier fluid from the body of water;

a barrier fluid outlet in communication with a barrier fluid inlet of the submersible fluid system and to supply the barrier fluid to the barrier fluid inlet of the submersible fluid system.

Aspect 136. The submersible barrier fluid supply system of aspect 135, including a filter downstream of the inlet and configured to filter the barrier fluid.

A number of embodiments have been described. Nevertheless, it will be understood that various modifications may be made. Accordingly, other embodiments are within the scope of the following claims.

What is claimed is:

1. A submersible barrier fluid supply system for a submersible well fluid system for operating submerged in a body of water, comprising:

a submersible vessel configured to withstand ambient pressure of a surrounding environment about the submersible vessel, wherein the surrounding environment is the body of water;

a barrier fluid inlet fluidically coupled to the surrounding environment and configured to intake a barrier fluid from the surrounding environment;

a pump disposed within the submersible vessel and fluidically coupled to the barrier fluid inlet and configured to pump the barrier fluid to a passage disposed within the submersible vessel;

a filter disposed within the submersible vessel and fluidically coupled to the passage and adapted to filter the barrier fluid;

a barrier fluid outlet fluidically coupled to the filter;

a reject passage disposed within the submersible vessel and configured to fluidically couple the passage to the surrounding environment;

a reject valve disposed within the submersible vessel and configured to control flow of barrier fluid through the reject passage; and an electric machine comprising an adjustable speed drive having an active power factor correcting front end that comprises an input power line filter and an active power factor correcting rectifier configured to switch at a frequency greater than 60 Hertz.

2. The submersible barrier fluid supply system of claim 1, comprising a housing internally defining a solids settling chamber exterior to and around the barrier fluid inlet, the housing comprising a water inlet adapted to intake water from the body of water into the solids settling chamber and settle solids at a first end of the solids settling chamber, wherein the barrier fluid inlet is arranged fluidically coupled to the solids settling chamber at a second end of the solids settling chamber opposite the first end.

3. The submersible barrier fluid supply system of claim 2, further comprising a membrane downstream of the filter, the membrane configured to further filter the barrier fluid.

4. The submersible barrier fluid supply system of claim 3, further comprising a second reject passage fluidically coupled to an upstream side of the membrane and configured to direct fluid that has not passed through the membrane to a solids settling chamber.

5. The submersible barrier fluid supply system of claim 1, where the filter comprises a multi-stage filter.

6. The submersible barrier fluid supply system of claim 5, where the multi-stage filter comprises a reverse osmosis membrane filter downstream from a coarse filter.

7. The submersible barrier fluid supply system of claim 1, comprising:

a first fluid circuit comprising the filter; and a second fluid circuit, in fluidic parallel to the first fluid circuit, and comprising a second filter.

8. The submersible barrier fluid supply system of claim 7, where the first fluid circuit comprises the pump and the second fluid circuit comprises a second pump; and where the submersible barrier fluid supply system comprises:

a first crossover passage fluidically coupling the first fluid circuit and the second fluid circuit downstream of the first and second pumps, between the first and second pumps and the filter and the second filter; and a second crossover passage fluidically coupling the first fluid circuit and the second fluid circuit at a location downstream of the filter and the second filter.

9. The submersible barrier fluid supply system of claim 7, comprising a clean-out circuit comprising:

a bypass crossover passage fluidically coupling the first fluid circuit and the second fluid circuit downstream of the filter and the second filter, the bypass crossover passage configured to supply a back flush flow of fluid to the second filter; and a third reject passage fluidically coupled to a passage between the barrier fluid inlet and the second filter to receive the back flush flow of barrier fluid from the second filter.

10. The submersible barrier fluid supply system of claim 7, comprising a clean-out circuit comprising:

a bypass fluidically coupling the first fluid circuit and the second fluid circuit downstream of the filter and the second filter, the bypass configured to supply a back flush flow of barrier fluid to one or both of the filter and the second filter; and a second reject passage fluidically coupled to a second passage between the barrier fluid inlet and the second filter to receive the back flush flow of barrier fluid from the second filter.

11. The submersible barrier fluid supply system of claim 1, where the submersible barrier fluid supply system is configured to supply barrier fluid to one or more seals of a fluid end of the submersible well fluid system.

12. The submersible barrier fluid supply system of claim 1, where the barrier fluid outlet is in fluid communication with a bellows chamber, the bellows chamber comprising a bellows, and where the submersible barrier fluid supply system is configured to supply barrier fluid to the bellows chamber upon expansion of the bellows.

* * * * *